US006080711A

United States Patent [19]

Brouwer et al.

[11] Patent Number: 6,080,711

[45] **Date of Patent: *Jun. 27, 2000**

[54] POWDER DETERGENT COMPOSITION AND METHOD OF MAKING

[75] Inventors: Steven J. Brouwer, Hudsonville; Michael J. Wint, Grand Rapids, both of Mich.

[73] Assignee: Amway Corporation, Ada, Mich.

[ * ] Notice: This patent is subject to a terminal disclaimer.

[21] Appl. No.: 09/041,060

[22] Filed: Mar. 10, 1998

Related U.S. Application Data

[63] Continuation of application No. PCT/US97/03865, Mar. 10, 1997, which is a continuation-in-part of application No. 08/616,442, Mar. 15, 1996, Pat. No. 5,714,451.

[51] Int. Cl.[7] ..... C11D 3/42; C11D 11/00; C11D 17/06

[52] U.S. Cl. ..... 510/324; 510/326; 510/356; 510/361; 510/394; 510/444; 510/461; 510/488; 510/509; 510/510; 8/648; 252/301.23

[58] Field of Search ..... 510/324, 326, 510/349, 356, 394, 361, 444, 461, 488, 509, 510; 8/648; 252/301.23

[56] References Cited

U.S. PATENT DOCUMENTS

| | | | |
|---|---|---|---|
| 3,446,893 | 5/1969 | Hanford et al. . | |
| 3,579,455 | 5/1971 | Sabatelli et al. . | |
| 3,597,361 | 8/1971 | Sumner . | |
| 3,627,686 | 12/1971 | Sabatelli et al. . | |
| 3,653,914 | 4/1972 | Schmitt . | |
| 3,664,961 | 5/1972 | Norris . | |
| 3,684,744 | 8/1972 | Shen et al. . | |
| 3,700,599 | 10/1972 | Mizuno et al. . | |
| 3,726,813 | 4/1973 | Borello . | |
| 3,761,415 | 9/1973 | Gould . | |
| 3,764,559 | 10/1973 | Mizuno et al. . | |
| 3,769,222 | 10/1973 | Yurko et al. . | |
| 3,799,880 | 3/1974 | Kelly et al. . | |
| 3,801,511 | 4/1974 | Lemoff . | |
| 3,846,346 | 11/1974 | Conn . | |
| 3,850,852 | 11/1974 | Neillie et al. . | |
| 3,886,098 | 5/1975 | DiSalvo et al. . | |
| 3,896,056 | 7/1975 | Benjamin et al. . | |
| 3,904,685 | 9/1975 | Shahidi et al. . | |
| 3,920,586 | 11/1975 | Bonaparte et al. | 510/349 |
| 3,922,230 | 11/1975 | Lamberti et al. . | |
| 3,933,670 | 1/1976 | Brill et al. . | |
| 3,933,673 | 1/1976 | Davies . | |
| 3,950,260 | 4/1976 | Eldib . | |
| 3,950,275 | 4/1976 | Toyoda et al. . | |
| 3,962,149 | 6/1976 | Chirash et al. . | |
| 3,993,574 | 11/1976 | Christ et al. . | |
| 3,998,762 | 12/1976 | Murata et al. . | |
| 4,049,467 | 9/1977 | Rubin . | |
| 4,051,054 | 9/1977 | Davies et al. . | |
| 4,059,538 | 11/1977 | Green et al. . | |
| 4,098,713 | 7/1978 | Jones . | |
| 4,125,475 | 11/1978 | Kolaian et al. . | |
| 4,140,650 | 2/1979 | Wilde . | |
| 4,142,044 | 2/1979 | Ghnther et al. . | |
| 4,180,467 | 12/1979 | Barth . | |
| 4,196,093 | 4/1980 | Clarke et al. . | |
| 4,203,858 | 5/1980 | Chakrabarti . | |
| 4,210,550 | 7/1980 | Cornelissens . | |
| 4,216,104 | 8/1980 | Gergely . | |
| 4,222,905 | 9/1980 | Cockrell, Jr. . | |
| 4,234,442 | 11/1980 | Cornelissens . | |
| 4,239,659 | 12/1980 | Murphy . | |
| 4,248,911 | 2/1981 | Wixon . | |
| 4,272,393 | 6/1981 | Gergely . | |
| 4,294,711 | 10/1981 | Hardy et al. . | |
| 4,294,718 | 10/1981 | Kaeser . | |
| 4,298,490 | 11/1981 | Lange et al. . | |
| 4,298,493 | 11/1981 | Schreiber . | |
| 4,309,316 | 1/1982 | Lange et al. . | |
| 4,311,606 | 1/1982 | Kaeser . | |
| 4,311,607 | 1/1982 | Kaeser . | |
| 4,326,971 | 4/1982 | Wixon . | |
| 4,362,640 | 12/1982 | Schreiber . | |
| 4,407,722 | 10/1983 | Davies et al. . | |
| 4,411,803 | 10/1983 | Wixon . | |
| 4,411,809 | 10/1983 | Wixon . | |
| 4,416,809 | 11/1983 | Magari et al. . | |
| 4,441,881 | 4/1984 | Ruppert et al. . | |
| 4,444,674 | 4/1984 | Gray . | |
| 4,457,854 | 7/1984 | Gangwisch et al. . | |
| 4,473,485 | 9/1984 | Greene . | |
| 4,478,598 | 10/1984 | Meyer et al. . | |
| 4,524,013 | 6/1985 | Lamberti . | |
| 4,534,876 | 8/1985 | Browne . | |
| 4,557,863 | 12/1985 | Collins . | |
| 4,576,727 | 3/1986 | Browne | 510/298 |

(List continued on next page.)

FOREIGN PATENT DOCUMENTS

| | | |
|---|---|---|
| 0 110 588 | 6/1984 | European Pat. Off. . |
| 2267911 | 12/1993 | United Kingdom . |

OTHER PUBLICATIONS

Prieto et al., United States Statutory Invention Registration, Reg. No. H1467, Publication Date: Aug. 1, 1995.

*Primary Examiner*—Lorna M. Douyon
*Attorney, Agent, or Firm*—G. Peter Nichols; Brinks Hofer Gilson & Lione

[57] ABSTRACT

A powdered laundry detergent is provided with (a) a powder laundry detergent base that includes an inorganic carrier and a surfactant and (b) post-added acidulant and discrete whitening agent particles to provide a detergent having improved cool water solubility with bulk color deterioration caused by whitening agents being minimized. The detergent includes from about 5% to about 80% of an inorganic carrier, from about 1% to about 90% of a detergent surfactant, from about 0.1% up to about 15% of an acidulant and from about 0.1% up to about 30% of the discrete whitening agent particles. The acidulant is selected from the group of acids that in an acid form are soluble in water in an amount not greater than about 8%, preferably not greater than about 0.7% by weight at 25° C. and in a salt form are soluble in water at least in an amount of about 15% by weight at 25° C. The whitening agent particles include a whitening agent and a surfactant. The whitening agent surfactant can consist of those anionics, nonionics, zwitterionics, ampholytics, cationics, and mixtures thereof that are solids in a temperature range of from about 32° F. (0° C.) to about 180° F. (82° C.). In a more preferred form, the whitening agent particles consist of a whitening agent, a surfactant, preferably an anionic surfactant, and water.

26 Claims, No Drawings

U.S. PATENT DOCUMENTS

| | | | |
|---|---|---|---|
| 4,589,989 | 5/1986 | Müller et al. . | |
| 4,612,137 | 9/1986 | Kuroda et al. . | |
| 4,619,710 | 10/1986 | Kuenn et al. . | |
| 4,652,391 | 3/1987 | Balk . | |
| 4,664,836 | 5/1987 | Taylor, Jr. et al. . | |
| 4,715,980 | 12/1987 | Lopes et al. . | |
| 4,720,399 | 1/1988 | Taha . | |
| 4,741,851 | 5/1988 | Borrello . | |
| 4,786,440 | 11/1988 | Cooper et al. . | |
| 4,806,173 | 2/1989 | Toukan . | |
| 4,818,424 | 4/1989 | Evans et al. . | |
| 4,820,441 | 4/1989 | Evans et al. . | |
| 4,853,259 | 8/1989 | Taha . | |
| 4,857,223 | 8/1989 | Borrello . | |
| 4,863,626 | 9/1989 | Coyne et al. . | |
| 4,869,843 | 9/1989 | Saito et al. . | |
| 4,879,105 | 11/1989 | Yorozu . | |
| 4,900,466 | 2/1990 | Atkinson et al. . | |
| 4,919,847 | 4/1990 | Barletta et al. . | |
| 4,923,628 | 5/1990 | Appel et al. . | |
| 4,931,203 | 6/1990 | Ahmed et al. . | |
| 4,954,292 | 9/1990 | Hull et al. . | |
| 4,970,017 | 11/1990 | Nakamura et al. . | |
| 4,992,079 | 2/1991 | Lutz . | |
| 5,002,758 | 3/1991 | Ichii et al. . | |
| 5,030,377 | 7/1991 | Sone et al. . | |
| 5,030,379 | 7/1991 | Knight et al. . | |
| 5,073,295 | 12/1991 | Bruttel et al. | 252/301.19 |
| 5,082,578 | 1/1992 | Langer et al. . | |
| 5,091,106 | 2/1992 | Jacobs et al. . | |
| 5,133,924 | 7/1992 | Appel et al. . | |
| 5,164,108 | 11/1992 | Appel et al. . | |
| 5,198,144 | 3/1993 | Ichii et al. . | |
| 5,225,100 | 7/1993 | Fry et al. . | |
| 5,259,994 | 11/1993 | Welch et al. . | |
| 5,279,756 | 1/1994 | Savio et al. . | |
| 5,300,250 | 4/1994 | Morgan et al. . | |
| 5,312,561 | 5/1994 | Hoshino et al. . | |
| 5,312,748 | 5/1994 | Liu et al. . | |
| 5,314,637 | 5/1994 | Saito et al. . | |
| 5,338,476 | 8/1994 | Pancheri et al. . | |
| 5,415,806 | 5/1995 | Pepe et al. . | |
| 5,458,799 | 10/1995 | Flower . | |
| 5,468,416 | 11/1995 | Outtrup et al. . | |
| 5,468,516 | 11/1995 | Yamashita et al. . | |
| 5,470,509 | 11/1995 | Pancheri . | |
| 5,714,450 | 2/1998 | Brouwer | 510/324 |
| 5,714,451 | 2/1998 | Brouwer et al. | 510/324 |
| 5,714,452 | 2/1998 | Brouwer | 510/394 |

POWDER DETERGENT COMPOSITION AND METHOD OF MAKING

This application is a continuation of PCT/US97/03865, filed on Mar. 10, 1997, which is a continuation-in-part of U.S. Ser. No. 08/616,442, filed on Mar. 15, 1996, now U.S. Pat. No. 5,714,451 each of which is incorporated herein by reference in their entirety.

BACKGROUND OF THE INVENTION

1. Field of the Invention

The present invention relates to a powder detergent that incorporates post-added acidulant and whitening agent particles and a method of making such a detergent. In particular, the powder contains a high level of surfactant yet is free flowing, does not cake, dissolves in cool water and does not suffer from bulk color deterioration during storage. The powder detergent contains discrete whitening agent particles to alleviate the bulk color deterioration typically associated with the degradation of fluorescent whiteners in nonionic containing powder detergents. The powder detergent also includes an acidulant to improve the solubility in the laundering solution as well as to improve the dissolution of the powder detergent in those washing machines having a detergent dispenser.

2. Discussion of Related Art

There is an on-going effort to provide powdered laundry detergents having an increased amount of detergent surfactants. The benefits of highly concentrated detergents include a savings in packaging use and cost. Unfortunately, there are limits to the amount of detergent surfactant that can be included in a powdered detergent while still providing the consumer desired characteristics of flowability, solubility, cleaning and whitening performance.

Most granular detergents are produced by spray drying. This process involves mixing detergent components such as surfactants and builders with water to form a slurry which is then sprayed into a high temperature air stream to evaporate excess water and to form bead-type hollow particles. While spray drying the detergent slurry produces a hollow granular detergent having an excellent solubility, extremely large amounts of heat energy are needed to remove the large amounts of water present in the slurry. Another disadvantage of the spray drying process is that because large scale production equipment is required, a large initial investment is necessary. Further, because the granules obtained by spray drying have a low bulk density, the granule packaging volume is large which increases costs and paper waste. Also, the flowability and appearance of the granules obtained by spray drying may be poor because of the presence of large irregularities on the surface of the granules.

In addition to these characteristic processing and product problems associated with the spray drying process, volatile materials, such as nonionic surfactants, are emitted into the air when processed by this method. This volatilization problem, manifested by the discharge of dense "blue" smoke from the spray tower, is referred to as "pluming." Air pollution standards limit the opacity of the plume. Consequently, it is necessary to limit the capacity of the spray tower or, in extreme instances, discontinue operation.

In an attempt to avoid the problems caused by spray drying, considerable developmental effort has focused on post-dosing the product with nonionic surfactants after the spray drying operation. Unfortunately, post-dosing of the spray dried base with surfactant in amounts sufficient to provide satisfactory wash performance generally results in a product that has poor dissolution characteristics. Accordingly, the amount of surfactant that may be employed in the detergent formulation is severely limited. Because heavy-duty laundry detergents need large amounts of nonionic surfactant, inorganic silicas have been added to these detergent formulations to absorb the nonionic liquids.

For example, U.S. Pat. No. 3,769,222 to Yurko et al. discloses mixing liquid nonionic surfactants with sodium carbonate until partial solidification occurs followed by the addition of large amounts of silica (silicon dioxide) to produce a dry free-flowing detergent composition. A disadvantage to this technique, however, is that because the silica has no significant cleaning activity, its inclusion in a detergent formulation in large amounts merely serves to increase the cost of the product. Further, the use of silica in detergents adds to the total suspended solids (TSS) content of laundry waste water contrary to the dictates of many local and state water pollution standards. Therefore, there is an incentive to keep low the amount of silica added to the detergent composition.

U.S. Pat. No. 4,473,485 to Greene reports that a free-flowing granular detergent can be prepared by mixing a polycarboxylic structuring agent solution with a micronized carbonate followed by the addition to the mixture of a nonionic surfactant and water, followed by removal of the excess water. The preferred micronized carbonate is calcium or sodium carbonate. A disadvantage of this process, however, is that the micronized carbonate used by Greene to enhance the flowability of the detergent product is quite expensive as compared to standard sodium carbonate. Without the use of the micronized carbonate, Greene's product would not have such good flowability. In addition, where the micronized carbonate is calcium carbonate, the building capability of the detergent is reduced.

Therefore, a need exists for a process that substantially overcomes the problem of free-flowability in highly loaded detergents, particularly highly loaded nonionic detergents. At the same time, these highly loaded, high density, powder detergents must dissolve under cool and/or cold water conditions that are becoming more prevalent world-wide. Granular laundry detergents containing admixed sodium carbonate are known to exhibit poor solubility under certain conditions. This poor solubility can cause clumps of detergent, which appear as solid white masses remaining in the washing machine and on washed clothes. Such clumps usually occur when the detergent is placed in a pile in the washing machine, particularly during cold water washes and/or when the order of addition to the washing machine is laundry detergent first, clothes second, and water last. The clumps may also occur when the powdered detergent is trapped within the folds or pockets of the fabrics to-be-washed, particularly in machines that do not provide for adequate agitation. It is believed that one contributor to this solubility problem is caused by hydration of the sodium carbonate and/or particle bridging resulting in a poorly soluble mass before the granular detergent can be dispersed and solubilized in the laundering solution.

Another problem exists when the laundry detergent contains high levels of nonionic surfactant. When such a detergent is added to the wash water, particularly when the temperature of the wash water is cool, the nonionic surfactant does not immediately solubilize. Instead, the surfactant may tend to gel resulting in a sticky mass which may deposit on the fabric before sufficient wash water is present to solubilize the nonionic surfactant.

U.S. Pat. No. 5,300,250 to Morgan et al. discloses that the addition of low levels of hydrophobic amorphous silicate material to granular laundry detergents containing admixed sodium carbonate improves their solubility in the laundering solution and eliminates or reduces the problem of clumps remaining in the washing machine and on washed clothes. The hydrophobic amorphous silicate material acts as an anti-caking agent and flow aid. The detergent is prepared by spray drying aqueous crutcher mixes of the surfactant and additives together with a premix containing sodium carbonate and hydrophobic amorphous silicate material.

U.S. Pat. No. 5,338,476 to Pancheri et al. discloses that spray dried granular laundry detergents having admixed sodium carbonate can achieve improved solubility in the laundering solution by incorporating citric acid. They report that they believe that the citric acid rapidly reacts with the sodium carbonate in the laundering solution to release carbon dioxide and helps to disperse the detergent and minimize the formation of insoluble clumps. The use of citric acid, in this manner, however, may not be desirable because a substantial portion of the citric acid may become neutralized to sodium citrate during storage. It is believed that the citric acid, which is hydroscopic, will absorb the free water present in the powder detergent formulation as well as in the atmosphere and become neutralized. The neutralization causes an unwanted increase in detergent particle size, powder lumps in the box, and loss of the desired effervescent effect.

U.S. Pat. No. 5,002,758 to Ichii et al. discloses bubbling bathing preparations preferably in the form of a tablet that contain fumaric acid and a carbonate together with carboxymethyl cellulose or an alkali metal salt or polyethylene glycol and less than 0.1% of a nonionic surface active agent. They also disclose that other organic acids may be used, for example, citric, tartaric, malic, malonic, pyridone carboxylic, succinic, adipic, phosphoric, and their salts.

A particular problem arises with the use of high density laundry detergent powders, i.e., those with bulk densities of 650 g/l or greater. Denser powders such as those of 800 g/l or higher are even more problematic. While these powders provide consumers the benefit of concentration and lower dosages, the processes required to produce high densities leave little or no void space in the detergent powder. For example, U.S. Pat. No. 5,133,924 describes a process that reduces the intraparticle porosity so that the void space is substantially decreased. These highly concentrated powders, however, can prove difficult to dissolve since the powder has little or no free space to allow the entry of water necessary for dissolution. This, in turn, can result in the powder forming localized areas of gelation which remain undissolved at the end of the wash cycle and contribute to residue. As a result, they are more susceptible to the cold water clumping problems.

U.S. Pat. No. 5,415,806 to Pepe et al. describes high density laundry detergent compositions having a bulk density of 650 g/l or greater and intraparticle porosities of about 25% or less. They report that acceptable solubility and dispersion is achieved by including a $C_{2-4}$ alkylene oxide condensation product as a solubility aid. The process of making the described detergent composition includes preparing a base powder by mixing water plus detergent components in a slurry and spray drying the slurry. Consequently, the described process does not offer an improvement to the known disadvantages of spray drying. In addition, the compositions are those with high density but low porosity. As a result, the amount of surfactant that can be effectively loaded is restricted. Moreover, without the solubility aid it is likely that the detergent would not be effectively dissolved or dispersed.

Another problem that exists with the use of higher density powder detergents is that they are not completely dispensed when used in automatic washing machines or those types of washing machines that are prevalent in Europe. In those machines, water enters the dispenser which is charged with the powder detergent and flushes the powder into the wash liquor. If the water does not flush out the entire amount of powder, the powder, when it solidifies, can form relatively large clumps that can eventually block the dispenser and/or feed pipe from the dispenser to the washing compartment of the machine. This wastes detergent and produces a lower level of cleaning. It also requires the user to clean out the dispenser and/or feed line, preferably after each wash cycle.

This problem is more prevalent with higher density powders, particularly in non-phosphate, zeolite-containing products and at low wash temperatures, including cold-water washes, and at low water pressure and/or water flow rates. While the phenomenon is not fully understood, solubilization of at least a portion of the powder detergent to form a pasty or syrupy consistency slurry before the powder has been washed out of the dispenser into the wash liquor appears to be a contributing factor.

Therefore, there is also a need for a powder detergent that will effectively dissolve in cool water, particularly those powdered detergents that contain high levels of surfactants. One problem with powder detergents containing high levels of nonionic surfactants, however, is that they may detrimentally affect whitening agents added to the detergent.

For example, it is known to add whitening agents to washing detergents in order to enhance the whiteness and brightness of the washed textiles. In particular, fluorescent whitening agents (FWAs) counteract the yellowing of cotton and synthetic fibers. FWAs are adsorbed on fabrics during the washing process. FWAs function by absorbing ultraviolet light, which is then emitted as visible light, generally in the blue wavelength ranges. The resultant light emission yields a brightening an whitening effect, which counteracts yellowing or dulling of the fabric. If, however, the whitener, particularly a fluorescent whitener, is incorporated in powdered detergents in the customary manner, they have an exceedingly undesirable drawback. Frequently, they cause a deterioration in the bulk appearance of the detergent. Unattractive, yellow or greenish-yellow powders of reduced commercial value are produced. Without being bound by any particular theory, it is believed that the whitening agents react with the detergent surfactants causing the agent to change forms and thereby cause the bulk appearance of the detergent to change. This reaction appears to be particularly prevalent when the detergent contains a substantial amount of nonionic surfactant.

One solution that has been proposed is to select a fluorescent whitening agent that may be more stable in a detergent containing a high nonionic surfactant concentration. The drawback to such whitening agents is that they lack cold water performance and they are expensive.

Another solution that has been proposed is reported in U.S. Pat. Nos. 4,298,490 and 4,309,316 to Lange et al. In these patents, a fluorescent whitener such as a bis-styrylbiphenyl, a bis-triazoylstilbene or naphthotriazolylstilbene type, is dissolved or dispersed in a mixture of water and a polymer (polyvinyl alcohol or polyvinyl pyrrolidone) and then added to the detergent slurry which is then later dried. Alternatively, the whitener solution or dispersion may be spray dried, suspended in water, added to the detergent slurry and then spray dried. These methods, however, require many processing steps prior to incorporation into a detergent slurry.

Therefore, there is a need for a powder detergent that contains a high level of surfactant to achieve desirable cleaning performance, yet is able to dissolve in cold water conditions and provide a whitening agent so that the bulk powder detergent does not suffer from discoloration upon storage.

SUMMARY OF THE INVENTION

It has now been discovered that the above problems can be alleviated by incorporating into a base powder detergent at least one post-added acidulant to improve the solubility of the powder laundry detergent, particularly in cold water washing as well as post-adding a whitening agent which has been made into a discrete particle. By incorporating an acidulant according to the present invention, improved dispensing should result, particularly in European-type washing machine dispensers. By forming the whitening agent into discrete particles, the intimate interaction between the whitener and the detergent ingredients is minimized so that the degradation of the whitening agent, and consequently, the degradation in the bulk appearance of the detergent is minimized if not substantially alleviated.

Generally, the powder detergent includes (a) a laundry detergent base comprising an inorganic carrier and a detergent surfactant and (b) post-added acidulant and whitening agent particles.

The laundry detergent base of the present, invention comprises, by weight, from about 5% to about 80% of an inorganic carrier; from about 1% to about 90% of a detergent surfactant selected from the group consisting of anionics, nonionics, zwitterionics, ampholytics, cationics, and mixtures thereof. In a preferred embodiment, the laundry detergent base of the present invention comprises, by weight, from about 20% to about 70% of an inorganic carrier; from about 10% to about 50% of a detergent surfactant selected from the group consisting of anionics, nonionics, zwitterionics, ampholytics, cationics, and mixtures thereof.

In a preferred embodiment, the laundry detergent base of the present invention includes a free-flowing agglomerated powder. The agglomerated powder comprises an alkali metal carbonate present in about 5% to about 80% weight of the final product; a detergent surfactant present in about 5% to about 50% by weight of the final product; and from about 0.1% up to about 25% by weight of the final product of an alkali metal salt of a carboxylic acid, wherein the carboxylic acid is selected from those carboxylic acids that, below a first temperature, have a greater water solubility than the water solubility of its corresponding alkali-metal salt. As will be described below, the first temperature is from about 15° C. to about 40° C.

Preferably, the agglomerated detergent base powder of the present invention comprises from about 5% to about 80% sodium carbonate, from about 5% to about 50% of a nonionic detergent surfactant, wherein the nonionic surfactant is the sole detergent surfactant present in the base, and from about 4% to about 18% of sodium citrate, sodium malate, and mixtures thereof. More preferably, the agglomerated detergent base powder of the present invention comprises from about 20% to about 70% of sodium carbonate, from about 20% to about 40% of a nonionic detergent surfactant wherein the nonionic surfactant is the sole detergent surfactant present in the base; and from about 5% to about 13% of a substantially completely neutralized carboxylic acid selected from the group consisting of sodium citrate, sodium malate, and mixtures thereof, wherein the sodium citrate or sodium malate is formed by the reaction, upon the addition of water, between a premix comprising (a) nonionic surfactant coated sodium carbonate and (b) admixed citric acid, malic acid, or mixtures thereof.

The acidulant is selected from the group of acids that in an acid form are soluble in water in an amount not greater than about 8%, preferably not greater than about 0.7% by weight at 25° C. and in a salt form are soluble in water at least in an amount of about 15% by weight at 25° C. It has been discovered that the addition of an acidulant to a powdered laundry detergent base improves the solubility of the detergent in the laundering solution and eliminates or reduces the problem of clumps remaining in the washing machine and on washed clothes. Thus, the addition of an acidulant to a powder laundry detergent base should enhance the dispensability of the powder detergent from a dispenser for automatic washing machines such as European-style dispensers.

At the same time, the use of the acidulant as set forth in the present invention will not cause caking or clumping of the powder detergent during storage. It is believed that the acidulant as set forth in the present invention will find particular use in those powdered laundry detergents that have a high bulk density such as those described in U.S. Pat. No. 5,415,806, incorporated herein by reference. The acidulant is selected from the group of acids that, in an acid form, are no more than sparingly soluble in water and in a salt form are soluble in water. The cation portion of the acidulant when it is in its salt form may be selected from the group of alkali metal and alkaline earth cations. Typically, since a substantial portion of a laundering solution will contain cations such as potassium, sodium, calcium, and magnesium, the cation of the salt form of the acidulant will preferably be one of potassium, sodium, calcium, or magnesium.

Preferably, the acidulant is non-hydroscopic. The terms "relatively insoluble" and "sparingly soluble" as used in the following specification and claims means that the acid form of the acidulant has a solubility in water of no more than about 8% by weight at 25° C. In particular, the acidulant is selected from the group of acids that in an acid form are soluble in water in an amount not greater than about 0.7% by weight at 25° C. and in a salt form are soluble in water at least in an amount of about 15% by weight at 25° C. Examples of acidulants having the required solubility include, but are not limited to fumaric, succinic, adipic, and boric acid. Therefore, in a preferred embodiment, the acidulant is selected from the group consisting of fumaric, succinic, adipic, and boric acid. Most preferably, the acidulant is fumaric acid.

The acidulant is incorporated into the powder detergent base in an amount from about 0.1% up to about 15%, preferably in an amount up to about 10%. Desirably, the weight ratio of inorganic carrier present in the detergent base to acidulant is from about 2:1 to about 15:1, more preferably from about 5:1 to about 10:1.

The whitening agent is formed as a discrete particle. The whitening agent (or whitener) particles can then be added to the detergent base in the normal manner, preferably after any drying step. By forming the whitening agent as a discrete particle, the intimate interaction between the whitener and the detergent ingredients is minimized and consequently, the degradation in the bulk appearance of the detergent is minimized, if not substantially prevented. In one form, the whitening agent particles comprise a whitener and a surfactant. In another, and more preferred form, the whitening agent particles comprise a whitener, an anionic surfactant, and water. The whitening agent can be any known fluorescent whitener. Preferably, the whitener is selected from the fluorescent whitening agents selected from the coumarins, diaminostilbenedisulfonic acids, diaminostilbenesulfonic acid-cyanuric chlorides, distyrylbiphenyls, naphthotriazoylstilbenes, pyrazolines and mixtures thereof. Preferably, the surfactant is compatible with the detergent surfactants and is selected from the group consisting of those anionics, nonionics, zwitterionics, ampholytics, cationics, and mixtures thereof that are solids in a temperature range of from about 32° F. (0° C.) to about 180° F. ( 82° C.). The whitening agent particles are incorporated into the detergent base at a level from about 0.1% up to about 30%, preferably up to about 15%, and more preferably up to about 5%.

The acidulant and whitening agent particles may be incorporated into detergent base compositions such as those produced by spray-drying, agglomerating, and other well known methods. For example, the spray drying process involves mixing detergent components including surfactants and builders with water to form a slurry which is then sprayed into a high temperature air stream to evaporate excess water and to form bead-type hollow particles. In this method, the acidulant and whitener particles can be added to the spray dried detergent composition after the excess water has been removed.

Alternatively, some methods of making detergent compositions contemplate the addition of binders to agglomerate the powder particles. Typically, premixed ingredients are tumbled in a large drum while binder solution is sprayed onto the tumbling particles. The agglomerate is then dried to remove the excess water. In this method, the acidulant and whitener particles can be added to the agglomerated composition after the water removal step.

The present invention also contemplates a method of making a powder detergent that comprises the steps of providing a powder laundry detergent base that comprises from about 5% to about 80% of an inorganic carrier and from about 1% to about 90% of a detergent surfactant selected from the group consisting of anionics, nonionics, zwitterionics, ampholytics, cationics, and mixtures thereof; admixing from about 0.1% up to about 15% of an acidulant; and admixing from about 0.1% up to about 30% of discrete whitening agent particles. Preferably, the method comprises the steps of providing a powder laundry detergent base that comprises from about 20% to about 70% of an inorganic carrier and from about 10% to about 50% of a detergent surfactant selected from the group consisting of anionics, nonionics, zwitterionics, ampholytics, cationics, and mixtures thereof; admixing from about 0.1% up to about 10% of an acidulant and admixing discrete whitening agent particles in an amount from about 0.1% up to about 15%.

Preferably, the method comprises providing an agglomerated laundry detergent powder base that comprises from about 5% to about 80%, preferably from about 20% to about 70%, and more preferably from about 30% to about 65% of sodium carbonate, and from about 1% to about 90% preferably from about 10% to about 50% and more preferably from about 20% to about 40% of a detergent surfactant selected from the group consisting of anionics, nonionics, zwitterionics, ampholytics, cationics, and mixtures thereof. In a more preferred embodiment, the detergent surfactant is a nonionic surfactant and is the sole detergent surfactant present in the detergent base. In this preferred embodiment, the agglomerated base powder also contains an alkali metal carboxylate. The alkali metal carboxylate is the salt of a carboxylic acid, wherein the carboxylic acid is selected from those carboxylic acids that, below a first temperature, have a greater water solubility than the water solubility of its corresponding alkali-metal salt. Preferably, the alkali metal carboxylate is selected from the group consisting of sodium citrate, sodium malate, and mixtures thereof. The alkali metal carboxylate is formed by the reaction of the sodium carbonate with the carboxylic acid, upon the addition of water during processing.

In this preferred embodiment, the process further includes the step of preparing a premix by loading sodium carbonate (and, optionally, other detergent ingredients) with a surfactant to form a homogeneous surfactant coated alkali metal carbonate; then admixing a carboxylic acid that is selected from the group of carboxylic acids that, below a first temperature (preferably from about 15° C. to about 40° C.), have a greater water solubility than the water solubility of its corresponding alkali-metal salt with the premix to form a mixture; incorporating water into the mixture to achieve agglomeration; drying the resulting agglomerate to form an agglomerated powder detergent base.

The term "coated" is used in the following specification and claims to mean that the surfactant is present on the surface of the carbonate as well as within carbonate particle (e.g. by absorption).

More preferably, the process of making the detergent base includes the steps of mixing sodium carbonate and a surfactant to form a homogeneous surfactant coated sodium carbonate premix; admixing a carboxylic acid to form a mixture, wherein the carboxylic acid is selected from the group of carboxylic acids that, below a first temperature, have a greater water solubility than the water solubility of its corresponding alkali-metal salt; introducing water onto the mixture; and agitating the mixture to accomplish agglomeration. Preferably, the mixture is fed to a rotating agglomerator where a minor amount of water is sprayed into the mixture as the agglomerator rotates. The agglomerate is preferably dried to remove the excess water, i.e., water not bound as the hydrate, to form the free-flowing detergent base.

Optionally, minor amounts of other known detergent ingredients may be present in the premix. For example, minor amounts of silicas and carboxymethylcellulose can be mixed with the alkali metal (sodium) carbonate prior to being loaded with the nonionic surfactant.

From about 0.1% up to about 15%, preferably up to about 10%, of an acidulant selected from the group of acids consisting of those that, in an acid form are soluble in an amount not greater than about 8%, preferably not greater than about 0.7 % by weight at 25° C. and in a salt form are soluble in water at least in an amount of about 15% by weight at 25° C.; and from about 0.1% up to about 30%, preferably up to about 15%, and more preferably up to about 5%, of discrete whitening agent particles wherein the whitening agent particles comprise, in one form a whitener and a surfactant and, in another preferred form comprise a whitener, a surfactant, and water, may be admixed with the agglomerated powder base to form the detergent of the present invention.

The term "free water" is used in the following specification and claims to indicate water that is not firmly bound as water of hydration or crystallization to inorganic materials.

Unless specifically noted otherwise, all percentages used in the specification and appended claims are by weight.

DETAILED DESCRIPTION OF THE INVENTION AND PREFERRED EMBODIMENTS

The present invention is directed to powder detergent compositions that contain post-added acidulant and discrete whitening agent particles. The term post-added refers to the addition of the particles after any substantial moderate to high temperature step such as, for example, drying. The powder laundry detergent comprises (a) a laundry detergent base comprising an inorganic carrier, a detergent surfactant, and, optionally, other known detergent adjuncts and (b) post-added acidulant and discrete whitening agent particles.

In one embodiment, the laundry detergent base includes an inorganic carrier, a detergent surfactant, and optionally, other known detergent adjuncts. The inorganic carrier can be present in an amount of about 5% to about 80% by weight of the final product. Generally, the amount of inorganic carrier present in the final product is balanced against the amount of surfactant present. The inorganic carrier is preferably included in an amount from about 20% to about 70% by weight of the final product. More preferably, the inorganic carrier is present in the range from about 30% to about 65% by weight of the final composition.

Suitable inorganic carriers are preferably builders that are also capable of binding or precipitating the salts responsible for hardness in water. The builders herein include any of the conventional inorganic and organic water-soluble builder salts. Such builders can be, for example, water-soluble salts of phosphates including tripolyphosphates, pyrophosphates, orthophosphates, higher polyphosphates, carbonates, silicas, silicates, and organic polycarboxylates. Specific preferred examples of inorganic phosphate builders include sodium and potassium tripolyphosphates and pyrophosphates.

The inorganic carrier preferably contains little (e.g., less than 10%, preferably less than 5%, by weight) or no phosphate builder materials. Consequently, the nonphosphorous-containing materials are preferred and include the alkali metal, e.g., sodium and potassium, carbonates, and silicas. Other suitable carriers will be evident to those skilled in the art. For example, aluminosilicate ion exchange materials may be useful in the detergent composition of this invention and may include the naturally-occurring aluminosilicates or synthetically derived. A method for producing aluminosilicate ion exchange materials is discussed in U.S. Pat. No. 3,985,669, incorporated herein by reference. Such synthetic crystalline aluminosilicate ion exchange materials are available under the designations Zeolite A, Zeolite B, and Zeolite X. In addition, layered or structured silicates such as those sold under the designation SKS-6 by Hoechst-Celanese, may also find use in the detergent composition.

Preferably, the inorganic carrier is an alkali metal carbonate that may include minor amounts of other suitable carriers. Among the alkali metal carbonates useful in the laundry detergent of the present invention are light density (LT) soda ash (Solvay process), mixtures of light density (LT) and medium density soda ash (Sesquicarbonate process), a special high porosity "medium-light" ash (Sesquicarbonate process) and mixtures of light density and "medium-light" ash. These particles of sodium carbonate have an average density of from about 0.5 to about 0.7 and an average mesh size ranging from about 20 to about 200, U.S. Standard Sieve number. Carbonates such as these are commercially available from FMC Corp. and General Chemical and are relatively inexpensive as compared to more processed carbonates because they do not require further processing such as grinding.

The detergent surfactant is selected from the group consisting of anionics, nonionics, zwitterionics, ampholytics, cationics, and mixtures thereof. The detergent surfactant used in the present invention may be any of the conventional materials of this type which are very well known and fully described in the literature, for example in "Surface Active Agents and Detergents" Volumes I and II by Schwartz, Perry & Berch, in "Nonionic Surfactants" by M. J. Schick, and in McCutcheon's "Emulsifiers & Detergents," each of which are incorporated herein in their entirety by reference. The surfactant is present at a level of from about 1% to about 90%. Desirably, the surfactant is present at a level of from about 10% to about 50%, and preferably, the surfactant is included in an amount from about 20% to about 40%.

Useful anionic surfactants include the water-soluble salts of the higher fatty acids, i.e., soaps. This includes alkali metal soaps such as the sodium, potassium, ammonium, and alkyl ammonium salts of higher fatty acids containing from about 8 to about 24 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 8 to about 20 carbon atoms and a sulfonic acid or sulfuric acid ester group. Included in the term "alkyl" is the alkyl portion of acyl groups. Examples of this group of synthetic surfactants are the sodium and potassium alkyl sulfates, especially those obtained by sulfating the higher primary or secondary alcohols ($C_8$–$C_{18}$ carbon atoms) such as those produced by reducing the glycerides of tallow or coconut oil; and the sodium and potassium alkylbenzene sulfonates in which the alkyl group contains from about 10 to about 16 carbon atoms, in straight chain or branched chain configuration, e.g., see U.S. Pat. No. 2,220,099 and alkylbenzene sulfonates in which the average number of carbon atoms in the alkyl group is from about 11 to 14, abbreviated as $C_{11-14}$ LAS.

The anionic surfactants useful in the present invention may also include the potassium, sodium, calcium, magnesium, ammonium or lower alkanolammonium, such as triethanolammonium, monoethanolammonium, or diisopropanolammonium paraffin or olefin sulfonates in which the alkyl group contains from about 10 to about 20 carbon atoms. The lower alkanol of such alkanolammonium will normally be of 2 to 4 carbon atoms and is preferably ethanol. The alkyl group can be straight or branched and, in addition, the sulfonate is preferably joined to any secondary carbon atom, i.e., the sulfonate is not terminally joined.

The anionic surfactants useful in the present invention may also include the potassium, sodium, calcium, magnesium, ammonium or lower alkanolammonium, such as triethanolammonium, monoethanolammonium, or diisopropanolammonium paraffin or olefin sulfonates in which the alkyl group contains from about 10 to about 20 carbon atoms. The lower alkanol of such alkanolammonium will normally be of 2 to 4 carbon atoms and is preferably ethanol. The alkyl group can be straight or branched and, in addition, the sulfonate is preferably joined to any secondary carbon atom, i.e., the sulfonate is not terminally joined.

Other anionic surfactants that may be useful in the present invention include the secondary alkyl sulfates having the general formula

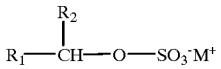

wherein M is potassium, sodium, calcium, or magnesium, $R_1$ represents an alkyl group having from about 3 to about 18 carbon atoms and $R_2$ represents an alkyl group having from about 1 to about 6 carbon atoms. Preferably, M is sodium, $R_1$ is an alkyl group having from about 10 to about 16 carbon atoms, and $R_2$ is an alkyl group having from about 1 to about 2 carbon atoms.

Other anionic surfactants useful herein are the sodium alkyl glycerol ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl group contains from about 10 to about 20 carbon atoms.

The ether sulfates useful in the present invention are those having the formula $RO(C_2H_4O)_xSO_3M$ wherein R is alkyl or alkenyl having from about 10 to about 20 carbon atoms, x is 1 to 30, and M is a water-soluble cation preferably sodium. Preferably, R has 10 to 16 carbon atoms. The alcohols can be derived from natural fats, e.g., coconut oil or tallow, or can be synthetic. Such alcohols are reacted with 1 to 30, and especially 1 to 12, molar proportions of ethylene oxide and the resulting mixture of molecular species is sulfated and neutralized.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane- 1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Another example of anionic surfactants that may be useful in the present invention are those compounds that contain two anionic functional groups. These are referred to as di-anionic surfactants. Suitable di-anionic surfactants are the disulfonates, disulfates, or mixtures thereof which may be represented by the following formula:

$$R(SO_3)_2M_2, R(SO_4)_2M_2, R(SO_3)(SO_4)M_2$$

where R is an acyclic aliphatic hydrocarbyl group having 15 to 20 carbon atoms and M is a water-solubilizing cation, for example, the $C_{15}$ to $C_{20}$ dipotassium-1,2-alkyldisulfonates or disulfates, disodium 1,9-hexadecyl disulfates, $C_{15}$ to $C_{20}$ disodium 1,2-alkyldisulfonates, disodium 1,9-stearyldisulfates and 6,10-octadecyldisulfates.

Nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

For example, the nonionic surfactants may include the polyoxyethylene or polyoxypropylene condensates of aliphatic carboxylic acids, whether linear or branched chain and unsaturated or saturated, containing from about 8 to about 18 carbon atoms in the aliphatic chain and incorporating from about 5 to about 50 ethylene oxide or propylene oxide units. Suitable carboxylic acids include "coconut" fatty acid which contains an average of about 12 carbon atoms, "tallow" fatty acid which contains an average of about 18 carbon atoms, palmic acid, myristic acid, stearic acid, and lauric acid.

The nonionic surfactants can also include polyoxyethylene or polyoxypropylene condensates of aliphatic alcohols, whether linear or branched chain and unsaturated or saturated, containing from about 8 to about 24 carbon atoms and incorporating from about 5 to about 50 ethylene oxide or propylene oxide units. Suitable alcohols include the coconut fatty alcohol, tallow fatty alcohol, lauryl alcohol, myristyl alcohol, and oleyl alcohol.

Preferred nonionic surfactants are of the formula $R^1(OC_2H_4)_nOH$, where $R^1$ is a $C_8$–$C_{16}$ alkyl group or a $C_8$–$C_{12}$ alkyl phenyl group, and n is from 3 to about 80. Particularly preferred nonionic surfactants are the condensation products of $C_{12}$–$C_{16}$ alcohols with from about 5 to about 20 moles of ethylene oxide per mole of alcohol, e.g., a $C_{12}$–$C_{15}$ alcohol condensed with about 6 to about 9 moles of ethylene oxide per mole of alcohol. Nonionic surfactants of this type include the NEODOL™ products, e.g., Neodol 23-6.5, Neodol 25-7, Neodol 25-9 which are, respectively, $C_{12-13}$ linear primary alcohol ethoxylate having 6.5 moles of ethylene oxide, $C_{12-15}$ linear primary alcohol ethoxylate having 7 moles of ethylene oxide, and $C_{12-15}$ linear primary alcohol ethoxylate having 9 moles of ethylene oxide.

Alkyl saccharides may also find use in the composition. In general, the alkyl saccharides are those having a hydrophobic group containing from about 8 to about 20 carbon atoms, preferably from about 10 to about 16 carbon atoms, and a polysaccharide hydrophillic group containing from about 1 (mono) to about 10 (poly), saccharide units (e.g., galactoside, glucoside, fructoside, glucosyl, fructosyl, and/or galactosyl units). Mixtures of saccharide moieties may be used in the alkyl saccharide surfactants. Preferably, the alkyl saccharides are the alkyl glucosides having the formula $$R^1O(C_nH_{2n}O)_t(Z)_x$$

wherein Z is derived from glucose, $R^1$ is a hydrophobic group selected from the group consisting of alkyl, alkyl-phenyl, hydroxyalkyl, hydroxyalkylphenyl, and mixtures thereof in which the alkyl groups contain from about 10 to about 18 carbon atoms, n is 2 or 3, t is from 0 to about 10, and x is from 1 to about 8. Examples of such alkyl saccharides are described in U.S. Pat. No. 4,565,647 (at col. 2, line 25through col. 3, line 57) and U.S. Pat. No. 4,732,704 (at col. 2, lines 15–25), the pertinent portions of each are incorporated herein by reference.

Semi-polar nonionic surfactants include water-soluble amine oxides containing one alkyl moiety of from about 10 to 18 carbon atoms and two moieties selected from the group of alkyl and hydroxy alkyl moieties of from about 1 to about 3 carbon atoms; water-soluble phosphine oxides containing one alkyl moiety of about 10 to 18 carbon atoms and two moieties selected from the group consisting of alkyl groups and hydroxy alkyl groups containing from about 1 to 3 carbon atoms; and water-soluble sulfoxides containing one alkyl moiety of from about 10 to 18 carbon atoms and a moiety selected from the group consisting of alkyl and hydroxy alkyl moieties of from about 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present detergent. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Halides, methyl sulfate and hydroxide are suitable. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

The powder detergent base composition may be produced by any of the well known methods. For example, the powder detergent base may be produced by spray drying as disclosed in U.S. Pat. Nos. 5,338,476 and 5,415,806, each incorporated herein by reference in their entirety. The detergent composition may also be prepared by agglomerating as set forth in U.S. Pat. Nos. 4,473,485, 5,164,108 and 5,458,799, each incorporated herein by reference in their entirety.

In one embodiment, the detergent base is agglomerated in the manner fully set forth in U.S. Pat. No. 5,496,486 the entire disclosure of which is incorporated herein by reference.

In an alternative preferred embodiment, the detergent base is an agglomerated powder detergent containing an alkali metal carbonate loaded with a surfactant. In this preferred embodiment, the detergent composition comprises three essential ingredients: sodium carbonate, a surfactant, and a substantially completely neutralized carboxylic acid.

Among the preferred sodium carbonates are those described above. The sodium carbonate can be present in an amount of about 5% to about 80% by weight of the final product. The amount of sodium carbonate added to the final product is balanced against the amount of surfactant which will be loaded into the sodium carbonate as well as the amount which will be neutralized by the admixed carboxylic acid. The preferred range for the sodium carbonate is from about 20% to about 70%, more preferably from about 30% to about 65% by weight of the final product. It should be mentioned that within the preferred range the higher levels tend to be required under conditions of use at low product concentrations, as is commonly the practice in North America, and the converse applies under conditions of use at higher product concentrations, as tends to occur in Europe.

If desired, the sodium carbonate can be mixed with other minor amounts, not to exceed about 10% of the final product, of detergent ingredients before the surfactant is added to it. The order of addition is not critical so long as the carbonate is adequately coated with the surfactant. For example, the carbonate, optional ingredients, and surfactant may be mixed in the manner fully disclosed in U.S. Pat. Nos. 5,458,769 or 5,496,486, the entire disclosure of both are incorporated herein by reference.

Preferably, a minor amount, from about 0.1% up to about 5%, of a silica such as a silicon dioxide hydrate is mixed with the sodium carbonate prior to loading with the surfactant. A variety of siliceous substances are acceptable for addition to the detergent composition, although highly absorbent silica of the precipitated or fumed variety is preferred. The preferred siliceous compounds have oil absorption numbers of 150 to about 350 or greater, preferably about 250 or greater. As examples of operable silicas, the following siliceous material are representative: Sipernat 50, Syloid 266, Cabosil M-5, Hisil 7-600. Preferably, from about 0.5% to about 4% by weight of the final product, of silica is mixed with the sodium carbonate prior to loading by the surfactant. More preferably, from about 3% to about 4% of silica by weight of the final product is mixed with the sodium carbonate.

Low levels of carboxymethylcellulose, for example from about 0.1% up to about 5%, to aid in the prevention of soil suspended in the wash liquor from depositing onto cellulosic fabrics such as cotton, may also be mixed with the sodium carbonate prior to loading with the surfactant. Preferably, from about 1% to about 3%, more preferably from about 2% to about 3% of carboxymethylcellulose is mixed with the sodium carbonate prior to loading with the surfactant. In a preferred embodiment, both the silica and the carboxymethylcellulose are mixed with the sodium carbonate prior to being loaded with the surfactant.

The second essential ingredient is a detergent surfactant which may be any of the surfactants described above. Although the preferred surfactant is a nonionic surfactant, it is to be understood that any of the surfactants described above can be used individually or in combination. Thus, while the description below refers to nonionic surfactants, it is to be understood that the surfactants described above can be used with or without any nonionic surfactant and individually or in combination.

As noted, the surfactant is preferably a nonionic surfactant such as an ethoxylated alcohol, as described above. Nonionic surfactants of this type include the NEODOL™ products, e.g., Neodol 23-6.5, Neodol 25-7, and Neodol 25-9 which are respectively, a $C_{12-13}$ linear primary alcohol ethoxylate having 6.5 moles of ethylene oxide, a $C_{12-15}$ linear primary alcohol ethoxylate having 7 moles of ethylene oxide, and a $C_{12-15}$ linear primary alcohol ethoxylate having 9 moles of ethylene oxide.

Desirably, the ratio of sodium carbonate to surfactant is from about 2:1 to about 3.5:1. Preferably, the ratio is from about 2.2:1 to about 3.3:1, more preferably from about 2.3:1 to about 2.8:1. In the most preferred embodiment the ratio of sodium carbonate to surfactant is about 2.4:1.

The surfactants are therefore incorporated in an amount of about 5% to about 50% by weight of the final product. Of course, the detergent benefits of high surfactant concentration must be balanced against cost-performance. Therefore, the preferred range for the surfactants is from about 20% to about 40% by weight of the final product, more preferably, from about 20% to about 30%. Most preferably, the surfactant is present at a level of about 25%. It should be mentioned that within the above ranges the lower levels tend to be required under conditions of use at higher product concentrations, as is commonly the practice in Europe, and the converse applies under conditions of use at lower product concentrations, as tends to occur in North America and Asia.

In a more preferred embodiment, from about 5% to about 80% sodium carbonate is blended with from about 5% to about 50% of a nonionic surfactant, wherein the nonionic surfactant is the sole surfactant present to form a form a premix comprising a homogeneous mixture of nonionic surfactant coated sodium carbonate. More preferably, the premix is formed by blending from about 20% to about 70% of sodium carbonate with up to about 5%, preferably from about 0.5% to about 4% of silica, and from about 1% to about 3% of minor detergent ingredients including carboxymethylcellulose and, loading the sodium carbonate, silica, and carboxymethylcellulose with from about 20% to about 40% of a nonionic surfactant wherein the nonionic surfactant is the sole surfactant present in the premix. In this more preferred embodiment, the premix is formed by mixing from about 30% to about 65% of sodium carbonate, from about 0.5% to about 4% of a silica, from about 2% to about 3% of carboxymethylcellulose, and a minor amount of other optional detergent ingredients; and spraying from about 20% to about 30% of a nonionic surfactant wherein the nonionic surfactant is the sole detergent surfactant present in the premix, onto the mixed carbonate, silica, carboxymethylcellulose, and optional ingredients.

Loading, adsorption, and absorption of the surfactant onto the sodium carbonate (and into its porous structure) can be achieved by, for example, simple admixture with sufficient agitation to distribute the surfactant entirely on and within the sodium carbonate to form a premix comprising a homogeneous mixture of surfactant coated sodium carbonate. As noted above, "coated" includes absorption into the carbonate particles. The loading can be accomplished in any of the known mixers such as by a ribbon or plow blender. Preferably, the surfactant is sprayed onto the sodium carbonate and other optional ingredients, if present, while they are agitated. In preparing the premix, it is important that the sodium carbonate is sufficiently coated with the surfactant so that when water is later added, the water does not immediately contact uncoated carbonate and hydrate the carbonate. It is believed that excessive hydration of the carbonate reduces the amount of water available to solubilize the carboxylic acid which will require additional water to achieve the desired agglomerated particle size.

At the same time, if an excess amount of surfactant is present in the premix, the later admixed carboxylic acid may be coated with the excess surfactant. As a result, the amount of carboxylic acid available to solubilize and neutralize with the sodium carbonate will be reduced, which, in turn will reduce the agglomeration efficiency and require additional carboxylic acid to achieve the desired particle size.

As discussed above, the surfactant is added in an amount so that it is within a particular ratio with respect to the sodium carbonate. Within this ratio range, the surfactant adequately coats the sodium carbonate yet does not provide a substantial excess of surfactant which would then undesirably coat the carboxylic acid. Moreover, it is believed that the order of addition is important to achieving the desired agglomeration. By loading the sodium carbonate with the surfactant prior to the admixture of carboxylic acid and introduction of water, the desired particle size is achieved while still producing a free-flowing powder.

The third essential ingredient in the detergent base is the sodium salt of a carboxylic acid wherein the carboxylic acid is selected from those carboxylic acids that, below a first temperature, have a greater water solubility than the water solubility of its corresponding sodium salt. As will be discussed below, the first temperature is from about 15° C. to about 40° C. Preferably, the sodium carboxylate is provided solely by the reaction of the corresponding carboxylic acid and the sodium carbonate. Preferred sodium carboxylates are selected from the group consisting of sodium citrate, sodium malate, and mixtures thereof. Sodium citrate is the most preferred because citric acid is relatively inexpensive and is readily obtainable.

The sodium carboxylate is present in the detergent composition at a level from about 0.1% up to about 25%, preferably from about 4% to about 18% and is provided solely by the reaction of the carboxylic acid and the sodium carbonate. It is believed that when the amount of sodium carboxylate is within this range, the desired agglomeration of the surfactant loaded sodium carbonate will be efficiently achieved and will produce the desired particle size. More preferably, the sodium carboxylate is present at a level of from about 5% to about 13% and in the most preferred embodiment is present at a level of about 9% to about 11%.

Desirably, as will be further discussed below, the carboxylic acid should be substantially completely neutralized by reaction with the sodium carbonate to its corresponding sodium salt during processing. For example, malic acid should be substantially completely neutralized to sodium malate. Because of reaction and processing limitations, it is believed that the carboxylic acid is not completely neutralized. Therefore, it is desirable to neutralize at least about 90%, preferably at least about 95% and more preferably at least about 99% of the carboxylic acid to its sodium carboxylate. Preferably, the substantially completely neutralized carboxylic acid will be selected from the group consisting of the sodium salts of citric acid, malic acid, and mixtures thereof.

The amount of carboxylic acid to be admixed can be determined from the amount of substantially completely neutralized carboxylic acid desired in the final product as well as the amount of sodium carbonate present. It would be desirable to use the minimum amount of carboxylic acid necessary to achieve acceptable agglomeration. This amount, however, must be balanced against the desire to provide an amount of the sodium carboxylate in the final product sufficient to control hard water filming in those instances where hard water is used. Acid levels which are too high can result in lower alkalinity by neutralization of the sodium carbonate which can detrimentally affect detergent performance. Too little acid, on the other hand, reduces the ability of the acid salt hydrate to entrap the added moisture and hampers agglomeration. The carboxylic acid is therefore incorporated in an amount such that the ratio between the sodium carbonate and the carboxylic acid is in the range from about 6.5:1 to about 12:1, preferably in the range from about 6.5:1 to about 8:1, more preferably about 7:1.

The carboxylic acid is admixed with the premix at a level from about 0.1% up to about 18% by weight of the final product. The preferred range of admixed acid is from about 3% to about 13% by weight of the final product, more preferably from about 4% to about 10% and most preferably from about 7% to about 9%. The carboxylic acid is only lightly admixed with the premix prior to the later introduction of water to minimize the potential for coating of the carboxylic acid by the nonionic surfactant.

After the carboxylic acid is lightly admixed with the premix, a small amount of water is incorporated to accomplish agglomeration of the particles. The water may be incorporated as a mist, steam, or in another suitable fashion. Desirably, the amount of water used is as small as practical in order to minimize subsequent drying time, energy and thus cost. The water is therefore incorporated at a level from about 0.1% to no more than about 7%, preferably no more than about 5%. In a more preferred embodiment, the water is incorporated in a range between about 4% and about 5%.

The water is incorporated into the mixture using any suitable mixing apparatus to achieve agglomeration of the mixture. Preferably, a drum agglomerator is used. The agglomerator rotates to distribute the mixture along the length of the drum as the falling sheets of the mixture are sprayed with water to produce a well controlled agglomeration of the particles.

Without wishing to be bound by any particular theory, it is believed that the carboxylic acid is solubilized and neutralized by the sodium carbonate at the same time the sodium carbonate is hydrated. The carboxylic acid should be substantially completely neutralized to its corresponding sodium salt which, below a first temperature, is less water soluble than the acid form. During the neutralization of the carboxylic acid, the sodium carboxylate binds the surfactant coated sodium carbonate particles to agglomerate them and to produce the desired particle size. As the drum rotates and the particles are agglomerated, the larger particles move from the inlet end to the outlet end of the agglomerator where they exit and are conveyed to a dryer to remove the free water from the agglomerated particles. The agglomerator is preferably inclined from the inlet to the outlet so that as the particles agglomerate, the larger agglomerated particles move from the inlet end to the outlet end where they are conveyed to an air dryer to be dried.

In particular, while not wishing to be held to a specific theory, it is believed that the carboxylic acid is solubilized with the water and reacts with the sodium carbonate to become substantially completely neutralized. The salts of the carboxylic acids, for example, citric and malic, have a water solubility less than their acid form below a first temperature and therefore the salts come out of solution to bind and thus agglomerate the particles. As noted above, insufficient coating by the surfactant on the surface of the sodium carbonate will produce excessive hydration of the sodium carbonate. As a result, the water required to solubilize the carboxylic acid will not be available and additional water and processing time will be required to produce the desired agglomerated particle size. In addition, hydration of sodium carbonate is exothermic and excessive hydration of sodium carbonate will generate undesirable heat and increase the temperature of the mixture above the first temperature. At the same time, an excess of surfactant present in the premix may cause coating of the carboxylic acid resulting in a reduction of agglomeration efficiency. In addition, additional carboxylic acid and water may be required to achieve the desired agglomerated particle size. Consequently, the order of addition as well as the temperature are believed to be important to achieving the desired agglomeration and particle size.

It is believed that by adding the carboxylic acid after the premix has been formed, the desired solubilization of the carboxylic acid is achieved prior to a substantial reaction with the sodium carbonate. If the citric acid were admixed with the sodium carbonate prior to adding the surfactant, it is believed that the resulting product would not achieve the desired free flowing and dissolution properties.

As noted above, the preferred carboxylic acid has a greater water solubility than its corresponding sodium salt below a first temperature. An increase in temperature above the first temperature therefore adversely affects the relative solubility of the acid form of the carboxylic acid in comparison to the salt form which, in turn, adversely affects the agglomeration efficiency. As a result, the formation of the sodium salt of the carboxylic acid is controlled so as to prevent the temperature of the mixture from rising above the first temperature.

Generally, the first temperature can range from about 15° C. to about 40° C., preferably from about 32° C. to about 35° C. A first temperature higher than about 42° C. appears to adversely affect the product characteristics and is, therefore, undesirable.

It will be understood by one skilled in the art that several factors can be varied to control the residence time (i.e., the weight of the mixture on the bed divided by the total feed rate) and agglomerate size, e.g., feed rate to the drum, angle of the drum, rotational speed of the drum, the number and location of the water spray. The result of manipulating such factors is desired control of the particle size and density of the agglomerates that sent to the dryer.

The wetted agglomerated particles are dried to remove any free water. The drying may be accomplished by any known method such as by a tumbling dryer or air drying on a conveyor. As one skilled in the art will appreciate, the time, temperature, and air flow may be adjusted to provide for an acceptable drying rate. Using a high ambient temperature in the dryer can shorten the residence time in the dryer, while lower temperatures may unduly lengthen the residence time. Short residence times, however, may increase the risk of adversely affecting the stability of the agglomerates or of incompletely drying the agglomerate.

It is desirable to remove as much water as practicable since the presence of water, even when bound, may detrimentally react with post-added moisture sensitive detergent ingredients such as bleaches and enzymes. Therefore, in a preferred embodiment, a minor amount of water is added to accomplish agglomeration and furthermore, at least about 50% of the added water is removed by drying. More preferably, at least about 60% of the added water is removed by drying. Consequently, the resulting composition contains less than about 3% of bound water, more preferably less than about 2% of bound water.

The dried particles have an average particle mesh size of up to about 20 U.S. Standard Sieve number. Preferably, the particles have a particle mesh size such that about 90% of the particles are in the range from about 20 to about 100 U.S. Standard Sieve number. The resulting powder has a bulk density of at least 0.7 g/cc, preferably from about 0.8 to about 0.9 g/cc, more preferably from about 0.85 to about 0.9 g/cc.

The mixing steps in the process to prepare the detergent compositions of this preferred embodiment can be accomplished with a variety of mixers known in the art. For example, simple, paddle or ribbon mixers are quite effective although other mixers, such as drum agglomerators, fluidized beds, pan agglomerators and high shear mixers may be used.

The powder detergent base compositions described above may optionally contain other well known adjuncts for detergent compositions. These include other detergency builders, bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. Such ingredients are described in, for example, U.S. Pat. No. 3,936,537, incorporated herein by reference.

Water-soluble, organic builders may also find use in the detergent base compositions of the present invention. For example, the alkali metal, polycarboxylates such as sodium and potassium, salts of ethylenediaminetetraacetic acid, nitrilotriacetic acid, oxydisuccinic acid, mellitic acid, benzene polycarboxylic acid, polyacrylic acid, and polymaleic acid may be included.

Other polycarboxylate builders are the builders set forth in U.S. Pat. No. 3,308,067, incorporated herein by reference. Examples of such materials include the water-soluble salts of homo- and co-polymers of aliphatic carboxylic acids such as maleic acid, itaconic acid, mesaconic acid, fumaric acid, aconitic acid, citraconic acid, and methylenemalonic acid.

Other suitable polymeric polycarboxylates are the polyacetal carboxylates described in U.S. Pat. No. 4,144,226, and 4,246,495, both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Bleaching agents and activators that may find use in the present detergent base compositions are described in U.S. Pat. No. 4,412,934, and 4,483,781, both of which are incorporated herein by reference. Suitable bleach compounds include sodium perborate, sodium percarbonate, etc. and the like, and mixtures thereof. The bleach compounds may also be used in combination with an activator such as, for example, tetra-acetyl-ethylenediamine (TAED), sodium nonanoyloxybenzene sulfonate (SNOBS), diperoxydodecanedioc acid (DPDDA) and the like, and mixtures thereof. Chelating agents are described in U.S. Pat. No. 4,663,071, from column 17, line 54 through column 18, line 68, incorporated herein by reference. Suds modifiers are also optional ingredients and are described in U.S. Pat. Nos. 3,933,672, and 4,136,045, both incorporated herein by reference.

Smectite clays may be suitable for use herein and are described in U.S. Pat. No. 4,762,645, at column 6, line 3 through column 7, line 24, incorporated herein by reference. Other suitable additional detergency builders that may be used herein are enumerated in U.S. Pat. No. 3,936,537, column 13, line 54 through column 16, line 16, and in U.S. Pat. No. 4,663,071, both incorporated herein by reference.

The laundry detergent base compositions of the present invention can be formulated to provide a pH (measured at a concentration of 1% by weight in water at 20° C.) of from about 7 to about 11.5. A pH range of from about 9.5 to about 11.5 is preferred for best cleaning performance.

As indicated above, the acidulant is post-added to the powder detergent base in an amount from about 0.1% up to about 15% by weight of the final product. In this context, post-added refers to adding the acidulant to the detergent base after it has been dried, e.g. by spray drying or other method, and is ready to be packaged. The amount of acidulant admixed with the detergent base is balanced against the amount and type of inorganic carrier, and other manufacturing and consumer preferences. Preferably, the acidulant is incorporated in an amount from about 1% to about 10%, more preferably about 5% by weight of the final product.

The acidulant is selected from the group consisting of acids that, in an acid form are soluble in water in an amount not greater than about 8%, preferably not greater than about 0.7 % by weight at 25° C. and in a salt form are soluble in water at least in an amount of about 15% by weight at 25° C. Generally, substances that have a solubility in water not greater than about 8% by weight are considered to be sparingly soluble in water. In addition, acidulants having the desired solubility profile will typically not be hydroscopic. Consequently, caking, which is prevalent in powder detergents, particularly those having citric acid, is reduced, if not eliminated.

Examples of acidulants having the required solubility include fumaric acid, adipic acid, succinic acid, and boric acid. The acidulant is therefore selected from the group of acids consisting essentially of fumaric, adipic, succinic and boric acid and mixtures thereof. Preferably, the acidulant is fumaric acid.

The cation portion of the salt of the acidulant will generally be an alkali metal or alkaline earth metal. Preferably, the cation will be potassium, sodium, calcium or magnesium since a substantial portion of the laundering solution will contain those cations. More preferably, when the inorganic carrier is an alkali metal, particularly sodium carbonate, the cation will be sodium since the acidulant will react with the sodium carbonate of the powder detergent.

The acidulant is incorporated into the powder detergent base in an amount such that the ratio of alkali metal carbonate to acidulant is from about 2:1 to about 15:1 more preferably from about 5:1 to about 10:1.

The acidulant may be admixed with the powder detergent base in any suitable fashion with a variety of mixers known in the art such as simple, paddle or ribbon mixers although other mixers, such as ribbon or plow blenders, drum agglomerators, fluidized beds, pan agglomerators and high shear mixers may be used. Preferably, the acidulant is admixed with the powder detergent base after any water removal step. For example, it is known to spray dry a detergent mix to remove excess water. It is also known to dry detergents that have been made by an agglomerating process. Therefore, the acidulant is admixed with the dried detergent base.

By incorporating the acidulant into the powder detergent base as described above, the dissolution and dispensability of the powder detergent is increased even at cool water temperatures. Advantageously, the detergent composition resulting from the post- addition of the acidulant in accordance with the present invention is soluble in cool or cold water, i.e., the composition readily dissolves or disperses in water having a temperature between about 32° F. (0° C.) and 90° F. (32.2° C.), preferably between about 35° F. (1.6° C.) and 50° F. (10°C.). In particular, it has been found that the post addition of the acidulant described above results in a powder detergent that readily dissolves as compared to a powder detergent that does not contain the post addition of the acidulant. Because of the incorporation of the acidulant, no significant amount of product remains bound in the clothes or in the bottom of the washing machine after a typical cold water wash cycle, even when the order of addition to the washing machine has been reversed, i.e., detergent first, clothes second, and water last. It is therefore believed that the incorporation of an acidulant according to the present invention will increase or enhance the dispensability of the powder detergent from a dispenser for automatic washing machines such as European-style flush dispensers.

As indicated above and in accordance with the present invention, the whitening agent particles are post-added to the powder detergent base in an amount from about 0.1% up to about 15% by weight of the final product. In this context, post-added refers to adding the whitening agent particles to the detergent base after it has been dried, e.g. by spray drying or other method, and is ready to be packaged. In one form, the whitening agent particles comprise a whitening agent and a surfactant, preferably an anionic surfactant. Incorporation of the discrete whitening agent particles in accordance with the present invention results at least in a stabilizing of the appearance of the laundry detergent powder. The often observed greenish or yellowish discoloration of the detergent caused by the typical addition of fluorescent whitener can thus be reduced if not alleviated.

The amount of the whitening agent particles added to the laundry detergent depends upon the amount of whitening desired and the amount of nonionic surfactants present in the laundry detergent base. However, the amount must be balanced against the cost of the whitening agent. Generally, the amount of the whitening agent particles added to the detergent base is in a ratio of nonionic surfactant in the detergent base to whitening agent particles in the range of about 2:1 to about 40:1, preferably from about 4:1 to about 25:1, more preferably about 7:1. The composition of the present invention, in one form, relates to a whitening agent particle composition comprising a whitener (or whitening agent) and a surfactant that substantially completely isolates or protects the whitening agent. The composition may optionally include a plasticizer to provide a softer or more pliable particle. The composition is preferably in the form of a particle. The whitening agent particles comprise from about 50% to about 95% of a surfactant, from about 1% to about 50% of a whitener and, optionally from about 0.1% up to about 10% of a plasticizer wherein the surfactant is mixed with the whitener in a ratio of surfactant to whitening agent from about 1:1 to about 50:1, preferably from about 1:1 to about 25:1. It is believed that by providing at least an equal amount of surfactant and whitening agent the surfactant will substantially isolate or protect the whitening agent.

Among the whitening agents suitable for use within the scope of this invention are the fluorescent whitening agents. It is also believed that the whiteners disclosed in U.S. Pat. Nos. 4,294,711, 5,225,100, 4,298,490, 4,309,316, 4,411,803, 4,142,044, and 4,478,598 incorporated herein by reference may also be useful in the present invention. Preferably, the whitening agents are selected from those fluorescent whitening agents consisting of coumarins, diaminostilbenedisulfonic acids, diaminostilbenesulfonic acid-cyanuric chlorides, distyrylbiphenyls, naphthotriazoylstilbenes, and pyrazolines, and mixtures thereof.

The coumarin type of whitening agents have the general formula:

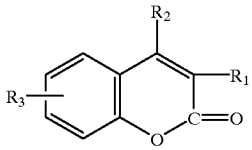

These coumarin whitening agents include 7-dimethylamino-4-methylcoumarin and 7-diethylamino-4-methylcoumarin.

The diaminostilbenesulfonic acid-cyanuric chlorides have the general formula:

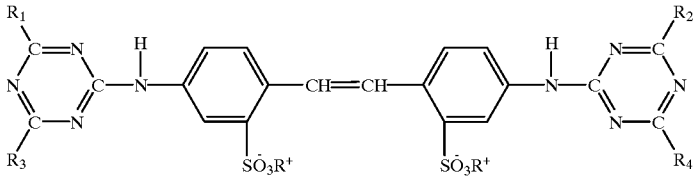

$R^+ = H^+, Na^+, K^+$, etc.

The diaminostilbenesulfonic acid-cyanuric chlorides include the 4,4N-Bis[(4,6-dianilino-s-triazin-2-yl)amino]-2,2N stilbenedisulfonic acids, or their alkali metal or alkanolamino salts, in which the substituted group is either morpholine, hydroxyethyl methylamino, dihydroxyethylamino or methylamino; the 4,4N-Bis{{4-anilino-6-[bis(2-hydroxyethyl)amino]-s-triazin-2-yl}amino}-2,2N-stilbenedisulfonic acids; the 4,4N-Bis[(4-anilino-6-morpholino-s-triazin-2-yl)amino]-2,2N-stilbenedisulfonic acids; the 4,4N-Bis[[4-anilino-6[N-2-hydroxyethyl-N-methylamino]-s]triazin-2-yl]amino]-2,2N-stilbenesulfonic acid disodium salts; and the 4,4N-Bis[[4-anilino-6-[(2-hydroxylpropyl)amino]-s-triazin-2-yl]amino]-2,2Nstilbenedisulfonic acid disodium salts.

The distyrylbiphenyl whitening agents have the general formula:

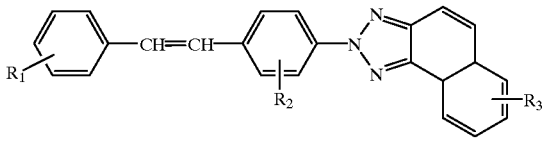

The distyrylbiphenyl whitening agents include the 2,2-(4,4N-Biphenylene divinylene)-dibenzenesulfonic acid, disodium salts. For example, Tinopal CBS (Ciba-Geigy) which is disodium 2,2N-bis-(phenyl-styrl) disulphonate may be useful. The 4-Benzooxazolyl-4N-oxadiazolyl stilbenes as disclosed in U.S. Pat. No. 4,142,044, the entire disclosure of which is hereby incorporated by reference, may also be suitable for use in the present invention.

The naphthotriazoylstilbene type whitening agents have the general formula:

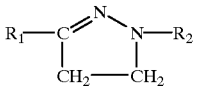

The naphthotriazoylstilbene type whitening agents include the 4-(2H-Naphtho[1,2-d]triazol-2-yl)-2-stilbenedisulfonic acid, sodium salts.

The pyrazoline type whitening agents have the general formula:

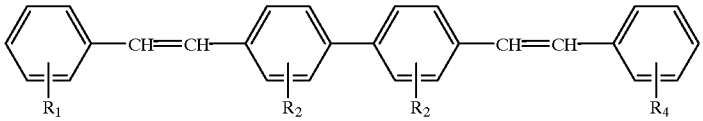

The pyrazoline type whitening agents include the p-[3-(p-Chlorophenyl)-2-pyrazolin-1yl]-benzenesulfonamides.

Preferably, the whitening agent is selected from the group consisting of the derivatives of disulfonated diaminostilbene/cyanuric chloride whiteners which have the general formula:

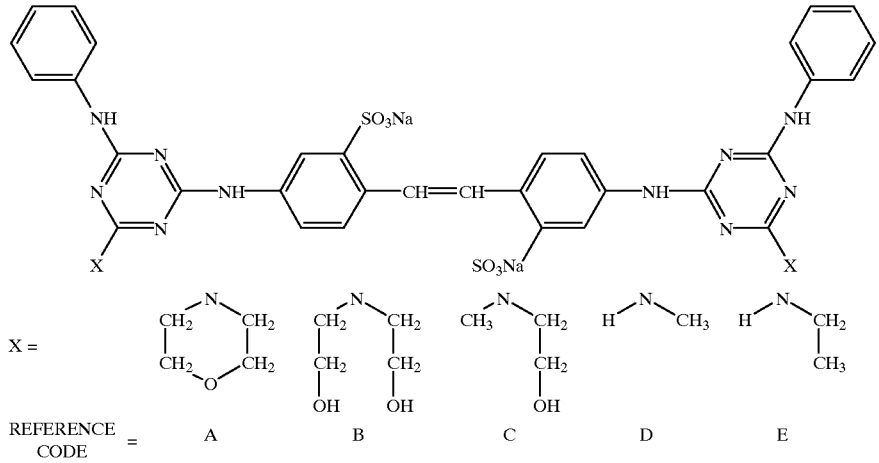

More preferably, the whitener is selected from the group of disulfonated diaminostilbene/cyanuric chloride whiteners wherein X has the formula A or C. An example of a whitener wherein X has the formula shown in A is the whitener marketed under the tradename Optiblanc 2M/G (by 3V Chemical Corp). When the 2M/G whitener is used, preferably the 2M/G LT version is used. An example of a whitener wherein X has the formula shown in C is Tinopal 5BM-GX.

The surfactant for the whitening agent particle is selected to be compatible with detergent surfactants that are typically included in laundry the detergent base. Preferably, the particle surfactant is selected from the group consisting of those anionics, nonionics, zwitterionics, ampholytics, cationics, and mixtures thereof that are solids in a temperature range of from about 32° F. (0° C.) to about 180° F. (82° C.). Suitable surfactants are fully described above as well as in the literature, for example in "Surface Active Agents and Detergents" Volumes I and II by Schwartz, Perry & Berch in "Nonionic Surfactants" by M. J. Schick, and in McCutcheon's "Emulsifiers & Detergents," each of which are incorporated herein by reference.

It will be appreciated that by using a surfactant for the whitening agent particles, the cleaning ability of the laundry detergent will not be hindered and may indeed be augmented by the presence of additional surfactant, particularly if the particle surfactant is an anionic surfactant. Moreover, by using a surfactant in the particle, the end product particles have an acceptable solubility in an aqueous medium, particularly a laundering solution.

The surfactants described above for the detergent may be useful in preparing the whitener particle so long as they are a solid in a temperature range of from about 32° F. (0° C.) to about 180° F. (82° C.). For example, it may be possible to use alkyl saccharides or highly ethoxylated acids or alcohols (e.g. those having from about 30 to about 80 moles of ethylene oxide per mole of acid or alcohol). Of course it will be understood by one skilled in the art that the nonionic surfactants will be less desirable as compared to the anionic surfactants since nonionic surfactants generally affect not only the stability of the whitener but also the ability of the whitener to effectively deposit on the fabric.

With the foregoing considerations in mind, nonionic surfactants may be useful in the instant composition. It has, however, been found that when the detergent surfactants comprising the laundry detergent base include a substantial amount of nonionic surfactant, the surfactant in the whitening agent particle is preferably an anionic surfactant. More particularly, in the more preferred embodiment when a nonionic surfactant is the sole detergent surfactant present in the detergent base, the particle surfactant is advantageously an anionic surfactant. Useful anionic surfactants include all the anionic surfactants described above. Preferably, the anionic surfactant is a sodium alkyl sulfate, wherein the alkyl portion has from about 8 to about 20 carbon atoms, such as, for example, sodium lauryl sulfate.

The whitener and particle surfactant are mixed in a ratio of surfactant to whitening agent from about 1:1 to about 50:1, preferably from about 1:1 to about 25:1. More preferably, the ratio of particle surfactant to whitening agent is in the range from about 2:1 to about 10:1 with the most preferable range being from about 2:1 to about 5:1. It is believed that, by providing at least an equal amount of surfactant and whitening agent that in the resulting particles, the surfactant will substantially isolate or protect the whitening agent from the deleterious effects of any nonionic surfactant present.

Optionally, a plasticizer may be included in the present composition in an amount to provide for a softer or more pliable end product. The plasticizer may be any of the well known plasticizers in the extrusion art such as water, mineral oil, fatty alcohols, fatty acids, alkoxylated fatty acids, alkoxylated alcohols, including the salts of the fatty alcohols, fatty acids, alkoxylated fatty acids, and alkoxylated alcohols, and the like, and mixtures thereof.

Surprisingly, it has been found that nonionic surfactants are desirable plasticizing agents and may include the nonionic surfactants described above. In particular, the nonionic surfactants having the formula $R^1(OC_2H_4)_nOH$, where $R^1$ is a $C_8$–$C_8$ alkyl group or a $C_8$–$C_{12}$ alkyl phenyl group, and n is from 3 to about 80 are preferred. Particularly preferred nonionic surfactants are the condensation products of $C_{10}$–$C_{16}$ alcohols with from about 5 to about 20 moles of ethylene oxide per mole of alcohol, e.g., a $C_{12}$–$C_{15}$ alcohol condensed with about 6 to about 9 moles of ethylene oxide per mole of alcohol. Nonionic surfactants of this type include the NEODOL™ products, e.g., Neodol 23-6.5, Neodol 25-7, and Neodol 25-9 which are, respectively, a $C_{12-13}$ linear primary alcohol ethoxylate having 6.5 moles of ethylene oxide, a $C_{12-15}$ linear primary alcohol ethoxylate having 7 moles of ethylene oxide, and a $C_{12-15}$ linear primary alcohol ethoxylate having 9 moles of ethylene oxide.

When a plasticizer is included in the whitening agent particle composition of the present invention, it is incorporated at a level from about 0.1% to no more than about 10% of the whitening agent particle end product. If too much plasticizer is included, the resulting end product may be too pliable to be effectively admixed into the detergent. Preferably, the plasticizer is included at a level from about 0.1% to no more than about 5%, more preferably no more than about 3% of the whitening agent end product. At these levels the ratio of surfactant to plasticizer is at least about 2:1. Preferably, the ratio of surfactant to plasticizer is from at least about 5:1 up to about 50:1, more preferably from about 20:1 to about 40:1, and most preferably from about 30:1 to about 40:1.

Other typical detergent ingredients may also be included in the whitening agent particle so long as they do not deter from the sought after advantage resulting from forming the whitening agent into a discrete particle. In particular, such detergent ingredients as silicones, defoamers, citric acid, sodium carbonate, phosphates, and other builders may be incorporated in the mixture.

It has now been found that a whitening agent particle that consists of a whitening agent, a surfactant, preferably an anionic surfactant, and water is particularly effective. In this form, the whitening agent particle comprises from about 50% to about 95% of a surfactant, from about 1% to about 50% of a whitener, and from about 0.1% up to about 10% of water. Preferably, the surfactant is mixed with the whitener in a ratio of surfactant to whitening agent from about 1:1 to about 50:1, preferably from about 1:1 to about 25:1, more preferably from about 1:1 to about 5:1, most preferably from about 2:1 to about 3:1. Also, the water, as a plasticizer, is added in a ratio of surfactant to water from about 5:1 to about 70:1, preferably from about 20:1 to about 40:1, more preferably from about 30:1 to about 40:1.

To prepare the whitening agent composition, the whitener and surfactant, and, optionally the plasticizer, are mixed in the desired amounts to form a substantially homogeneous mass which can be worked according to well known techniques until it is sufficiently "doughy" or plastic to be in suitable form for, preferably, extrusion or other process, e.g., pelleting, granulation, stamping and pressing. As an example, the whitener and surfactant may be charged to a mixer where they are mixed while being sprayed with the plasticizer. The wetted mixture is then formed into discrete particles. Alternatively, the whitener may be continuously metered to a mixing tank separately from the surfactant which is also continuously metered to the mixing tank where the whitener and surfactant are mixed while being sprayed. An amount of the wetted mixture is continuously removed from the mixing tank and formed into discrete particles by, for example, an extrusion process.

It is contemplated that the surfactant could be sprayed onto the whitening agent to encapsulate the whitening agent. However, such a process would require solubilization or dispersion of the surfactant and subsequent drying after spraying the whitening agents, which necessarily requires additional processing steps. In addition, the drying may cause heat degradation of the whitening agent.

Preferably, the mixture is extruded through, for example, a screw type extruder. When the mixture is extruded, it is extruded at a die exit temperature of about 100° F. (38° C.) to about 180° F. (82° C.), preferably at a die exit temperature of about 130° F. (54° C.) to about 160° F. (71° C.). The extrusion die head may be selected in accordance with the desired shape, i.e., geometric form, desired in the extrudate. For example, the extrudate may take the shape of spaghetti or noodles, although other shaped forms such as flakes, tablets, pellets, ribbons, threads and the like are suitable alternatives. To provide a particle wherein the whitening agent is sufficiently protected, the die slot is preferably shaped so that the extrudate takes the shape of spaghetti. In this preferred shape, the die slot has a diameter of about 0.1 mm to about 5 mm with a preferred range of from about 0.5 mm to about 2.5 mm, more preferably from about 0.5 mm to about 1.5 mm. The die slot diameter determines the diameter of the resulting particle and in the process of the present invention the diameter of the resulting particle is approximately the same as the die slot diameter. Therefore, the particles of the present invention have a diameter of about 0.1 mm to about 5 mm with a preferred range of from about 0.5 mm to about 2.5 mm, more preferably from about 0.5 mm to about 1.5 mm. Die slot diameters greater than about 5 mm will produce particles having a reduced dissolution rate as compared to those within the preferred range.

The spaghetti has an average length from about 0.1 mm to about 30 mm with about 95% thereof within a tolerance of about 0.5 mm to about 20 mm. More preferably, the spaghetti has an average length from about 0.5 mm to about 10 mm. Most preferably, the average length is from about 1 to about 3 mm. An excessive length may lead to segregation of the particles during use. At the same time, an excessively short length may increase the total surface area of the extrudate which may cause increased surface dusting and bleeding of color from the whitening agent particles.

In a preferred embodiment, the whitening agent composition consists essentially of a whitening agent, a surfactant and, optionally a plasticizer, wherein the whitening agent, surfactant and plasticizer are those described above. In this preferred embodiment, it is desirable to exclude those additional ingredients that may adversely affect the solubility or stability of whitening agent. In a more preferred embodiment, the whitening agent composition consists only of a whitening agent, a surfactant and, optionally a plasticizer wherein the whitening agent, surfactant and plasticizer are those described above.

The following examples are for illustrative purposes only and are not to be construed as limiting the invention.

EXAMPLE 1

The ingredients listed in Table 1 were agglomerated into an acceptable free-flowing powder detergent base in the following manner. The sodium carbonate, whitener, silica, and carboxymethylcellulose were mixed for about 1 minute in a ribbon mixer to achieve a uniform mixture. Neodol 25-7 (a $C_{12-15}$ alcohol ethoxylated with 7 moles of ethylene oxide) was poured into the above mixture while mixing to uniformly coat the sodium carbonate and other ingredients. The loaded sodium carbonate (and other ingredients) were transferred to a laboratory scale agglomerator (O'Brien Industrial Equip. Co., 3 foot diameter, 1 foot long) which was rotated at about 9 rpm for about 2 minutes after which water was sprayed on the mixture to cause agglomeration of the particles. Thereafter, the mixture was dried to a moisture content of about 2.15. The resulting composition had a bulk density of 0.85 and had a Flodex value of 12 as tested in a Model No. 211, Hansen Research Corp. Flodex testing apparatus.

TABLE 1

| Material | Amount (weight %) |
|---|---|
| Sodium Carbonate (FMC Grade 90) | 55.88 |
| Brightener (Tinopal SWN) | 0.02 |
| Silica (Sipernat 50) | 3.0 |
| Carboxymethylcellulose | 2.0 |
| Neodol 25-7 | 22.0 |
| Citric Acid | 7.5 |
| Water (added) | 4.0 |
| Water (after drying) | 1.5 |
| Post-added fumaric acid | 5.0 |
| Post-added ingredients (fragrance, enzyme, whitener) | 3.1 |

EXAMPLES 2–4

The following ingredients were agglomerated in the same fashion as described in Example 1, above, with the results also shown in Table 2.

TABLE 2

| Material | Amount (Formula Weight) | | |
|---|---|---|---|
| Example No. | 2 | 3 | 4 |
| Sodium Carbonate | 55.88 | 55.88 | 53.18 |
| Silica | 3.0 | 3.0 | 3.0 |
| Carboxymethylcellulose | 2.0 | — | 2.0 |
| Brightener | 0.02 | 0.02 | 0.02 |
| Citric Acid | 7.5 | 7.5 | 7.5 |
| Water (added for agglomeration) | 4.0 | 4.0 | 4.0 |
| Water (after drying) | 2.2 | 1.2 | 1.2 |
| Density | 0.85 | 0.87 | 0.84 |
| Flodex | 12 | 9 | 10 |

EXAMPLES 5–6

Table 3 lists typical amounts of ingredients useful to make a free-flowing nonionic surfactant detergent base according to the present invention. The sodium carbonate, silica, and carboxymethylcellulose can be mixed and, while mixing, the nonionic surfactant can be sprayed onto the mixture to coat the mixture. The citric acid can then mixed and, while mixing, water can be sprayed onto the mixture to cause the particles to agglomerate. The agglomerated particles can be dried. Thereafter, any post-added optional ingredients like enzymes, fragrances, and the like can be added as well as an acidulant such as fumaric acid and whitening agent particles, in accordance with the present invention.

TABLE 3

| Materials | Amount (Weight %) | |
|---|---|---|
| Example No. | 5 | 6 |
| Sodium Carbonate | 59.6 | 53.2 |
| Silica | 3.0 | 3.0 |
| Carboxymethylcellulose | 2.2 | 2.0 |
| Pareth 25-7 | 24.7 | 22.0 |
| Citric Acid | 8.4 | 7.5 |
| Water (after drying) | 2.1 | 1.5 |
| Optional Minor Ingredients | — | 5.8 |
| Post-added fumaric acid | — | 5.0 |

EXAMPLE 7

The following example shows the beneficial effect of post-adding an acidulant to a powder detergent base according to the present invention when compared to a powder detergent base without the post-added acidulant as well as to powder detergent bases containing citric acid or its salt. The powder detergent base contained the following ingredients: 56% of sodium carbonate, 32% of silica, 2.1% of carboxymethylcellulose, 23.2% of Pareth 25-7 (a $C_{12-15}$ alcohol ethoxylated with 7 moles of ethylene oxide), 7.9% of citric acid, 4.2% of added water (with 2.6% removed by drying), with 6% of detergent ingredients such as fragrance, enzyme, anionic surfactant and fluorescent whitening agent. Each of the examples were tested in the following manner. A 20 gram amount of each substance to-be-tested was weighed and transferred to an open 4 ounce jar. The jar was stored for 3 days at 100° F. and 80% relative humidity. The results are reported in Table 1.

TABLE 4

| Material | Condition after storage |
|---|---|
| Citric Acid | very wet syrupy cake |
| Fumaric Acid | surface crust, but not wet |
| A 2:1 mixture of citric acid to fumaric acid (Provided as Ultraspheres by Haarmann & Riemer) | wet, particles stuck together |
| Ultraspheres of citric acid | wet, particles stuck together |
| Ultraspheres of monosodium citrate | wet, particles stuck together |
| Powder detergent | surface crust |
| Powder detergent containing 5% by weight citric acid | caked solid |
| Powder detergent containing 5% by weight fumaric acid | surface crust |
| Powder detergent containing 5% by weight of ultraspheres of monosodium citrate | caked solid |
| Powder detergent containing 5% by weight of ultraspheres of a 2:1 ratio of citric to fumaric acid | caked |

EXAMPLES 8–11

A number of formulations are presented in Table 5 to outline the scope of this invention. Various types of acidulants as shown in Examples 8–11 may be added to the powder detergent base.

TABLE 5

| Material<br>Example No. | 8 | 9 | 10 | 11 |
|---|---|---|---|---|
| Sodium Carbonate | 53.18 | 53.18 | 53.18 | 53.18 |
| Silica | 3.0 | 3.0 | 3.0 | 3.0 |
| Carboxymethyl-cellulose | 2.0 | 2.0 | 2.0 | 2.0 |
| Citric Acid | 7.5 | 7.5 | 7.5 | 7.5 |
| Pareth 25-7 | 22.0 | 22.0 | 22.0 | 22.0 |
| Water (for reaction) | 4.0 | 4.0 | 4.0 | 4.0 |
| Water (removed) | 2.5 | 2.5 | 2.5 | 2.5 |
| Post-added Adipic acid | 5.0 | — | — | — |
| Post-added Succinic acid | — | 5.0 | — | — |
| Post-added Boric acid | — | — | 5.0 | — |
| Post-added Fumaric acid | — | — | — | 5.0 |
| Post-added whitening agent particles | 3.6 | 3.6 | 3.6 | 3.6 |
| Post-added optionals | 2.22 | 2.22 | 2.22 | 2.22 |

TEST PROCEDURE

In the following examples, the following test was used to provide an indication of the ability of a powder detergent to dissolve in a wash liquor. An acrylic sock is filled with a measured amount of the to-be-tested detergent. The detergent is pushed to the toe of the sock. The sock is closed by using a tie wrap. To simulate typical wash conditions in North America, a washing machine prevalent in North America is used, for example, a Maytag washing machine. In this case, 30 grams of the to-be-tested detergent is put into the sock. Likewise, to simulate typical wash conditions in Japan, a washing machine prevalent in Japan is used, for example, a National washing machine. In this case, 12.5 grams of the to-be-tested detergent is put into the sock. The washing machine is set on a regular fabric wash cycle and is filled with water (17 gallons for the U.S. washer and 40 liters for the Japanese washer) at the desired temperature. The sock is placed into the water followed by a six-pound bundle of fabrics. The fabrics are washed and the sock is removed at the end of the wash cycle just at the onset of the rinse cycle. The sock is dried at ambient temperature. When dry, the sock is opened to determine if any powder detergent remains within the sock. A sock containing any powder detergent is considered to have failed the test. A sock containing no powder detergent is considered to have passed the test. The water temperature is decreased in 5° F. increments until powder remains in the sock. Since water having a temperature less than 45° F. was not available, the lowest water temperature tested was 45° F.

EXAMPLES 12–13

The following example demonstrates the effectiveness of the post-added acidulant in a dry blended detergent. In this example, the detergent was formulated by simply admixing the detergent ingredients. The detergents in examples 12 and 13 of Table 6 were tested in the sock test described above and did not fail until 50° F.; thus, demonstrating the beneficial effect of the post-added acidulant.

TABLE 6

| Material<br>Example No. | 12 | 13 |
|---|---|---|
| Sodium Carbonate | 61.18 | 56.18 |
| Silica | 4.0 | 4.0 |
| Carboxyymethylcellulose | 2.0 | 2.0 |
| Pareth 25-7 | 22.0 | 22.0 |

TABLE 6-continued

| Material<br>Example No. | 12 | 13 |
|---|---|---|
| Post-added Fumaric acid | 5.0 | 10.0 |
| Post-added Whitening Agent Particle | 3.6 | 3.6 |
| Post-added detergent ingredients (fragrance, enzymes) | 2.22 | 2.22 |

EXAMPLES 14–18

The following examples show the effectiveness of post-added acidulant. The sock test described above was used to determine the temperature of failure. Each detergent tested provided an identical amount of the nonionic surfactant to the wash liquor. For example, when the detergent of Example 14 was tested (it contained the ingredients described above for example 7), only 28.5 grams was used so that 22% by weight of the nonionic surfactant was being tested. Examples 15–18 used the powder detergent described in example 11. Example number 18 shows that post added citric acid is effective in achieving acceptable dissolution. However, as demonstrated in Example 7 and Table 4, the post-addition of citric acid detrimentally causes caking of the powder detergent.

TABLE 7

| Material<br>Example No. | 14 | 15 | 16 | 17 | 18 |
|---|---|---|---|---|---|
| Powder Detergent | 100 | 95 | 90 | 85 | 95 |
| Post-added fumaric acid | — | 5 | 10 | 15 | — |
| Post-added citric acid | — | — | — | — | 5 |
| Temperature at failure (°F.) | 70 | <45 | <45 | 50 | 50 |

COMPARATIVE EXAMPLES

The following commercially available powder detergents were tested in the sock test described above. The amount of detergent tested was based on the manufacturer's recommended use level.

TABLE 8

| Material | Temperature at failure (°F.) |
|---|---|
| Tide Ultra (65 g) | 80 |
| Attack (20 g)<br>(Kao Corp., available in Japan) | 80 |
| Enzyme Top (20 g)<br>(Lion, available in Japan) | 45 |
| Amway SA8 Phosphate Free (65 g) | 100 |
| Amway Japanese SA8 Phosphate Free (25 g) | 70 |

The Amway SA8 Phosphate Free formula has the following ingredients: 61.27% sodium carbonate, 3% sodium citrate, 2% cellulose gum, 2.0% sodium salt of an anionic polymer, 4.4% sodium silicate (spray dried), 14.5% Pareth 25-7 (a $C_{12}$–$C_{15}$ alcohol with 7 moles of ethylene oxide), 11.0% liquid sodium silicate, and 3.83% of detergent ingredients (enzymes, fragrance, whitener, brightener, PVP, soil dispersant, sodium hydroxide) with 2% water loss to drying.

The Amway Japanese SA8 Phosphate Free formula has the following ingredients: 62.02% sodium carbonate, 2.8% cellulose gum, 1.0% sodium salt of anionic terpolymer, 4.4% sodium silica, 3.0% sodium citrate, 11.05% of a mixture of Pareth 25-7 and Pareth 45-7 (a $C_{12}$–$C_{15}$ alcohol with 7 moles of ethylene oxide and a $C_{14}$–$C_{15}$ alcohol with 7 moles of ethylene oxide, respectively), 1.7% Pareth 25-3 (a $C_{12}$–$_{15}$ alcohol with 3 moles of ethylene oxide), 11% liquid sodium silicate, 6.03% detergent ingredients (fragrance, enzyme, whitener, brightener, soil dispersant, quaternary ammonium, sodium hydroxide) added after drying (loss of 3% water).

EXAMPLES 19–33

Examples 19–33 in Tables 9–12 show a number of formulations to outline the scope of the whitening agent particles that may be useful in the present invention. Examples 19–29 show various types of anionic surfactants as well as whiteners to illustrate the range of surfactants and whiteners. Examples 30–33 show possible adjuncts to the particle compositions. Each of the compositions in Examples 18–33 were prepared by mixing each of the ingredients and then extruding them through a one inch extruder having mixing pins (Bonnot Co.).

TABLE 9

| Example No. | 19 | 20 | 21 | 22 |
|---|---|---|---|---|
| Sodium paraffin sulfate | 50 | — | — | — |
| Sodium lauryl sulfate | — | 50 | 50 | 50 |
| Tinopal CBS-X | 50 | 50 | 25 | — |
| Tinopal UNPA-GX | — | — | 25 | — |
| Optiblanc 2M/G LT | — | — | — | 50 |

TABLE 10

| Example No. | 23 | 24 | 25 | 26 |
|---|---|---|---|---|
| Sodium lauryl sulfate | 75 | 80 | 75 | 75 |
| Tinopal UNPA-GX | 25 | 20 | — | — |
| Tinopal CBS-X | — | — | 25 | — |
| Optiblanc 2M/G LT | — | — | — | 25 |

TABLE 11

| Example No. | 27 | 28 | 29 |
|---|---|---|---|
| Sodium stearate | 78 | 75 | 75 |
| Tinopal 5BM-6X | 22 | — | — |
| Tinopal CBS-X | — | 25 | — |
| Optiblanc 2M/G LT | — | — | 25 |

TABLE 12

| Example No. | 30 | 31 | 32 | 33 |
|---|---|---|---|---|
| Sodium lauryl sulfate | 50 | 60 | 70 | 72.5 |
| Sodium carbonate | 22.5 | 10 | 12.5 | 10 |
| Tinopal CBS-X | 20 | 22.5 | 10 | 10 |
| Fumaric acid | 7.5 | 7.5 | 7.5 | 7.5 |

In the following examples, the color of the detergent particles is measured to provide a Whiteness Index which can provide an indication of the degradation of the whitening agent. The color is measured using a sphere spectrophotometer Model SP68J by X-Rite7 to provide a Whiteness Index. The use of such a spectrophotometer is known to those skilled in the art. In general, several readings of the tested material are taken and then averaged to provide an average Whiteness Index.

EXAMPLE 34

In the following example, a powder detergent containing whitening agent particles according to the present invention was tested to determine if the detergent exhibited undesirable color degradation. The detergent comprised 53.18% of sodium carbonate, 3% of silica, 2% of carboxymethylcellulose, 22% of Pareth 25-7 (a $C_{12}$–$C_{15}$ alcohol ethoxylated with 7 moles of ethylene oxide), 7.5% of citric acid for agglomeration, 4% of added water (of which 2.5% was removed by drying), 5% of post added acidulant (fumaric acid), 2.22% of detergent ingredients (brightener, fragrance, and enzyme), and 3.6% of a whitener particle that comprised sodium lauryl sulfate and Optiblanc 2M/G LT in a ratio of sodium lauryl sulfate to whitener of 3:1. Table 13 shows the average Whiteness Index at the start of the test, after one-month, and again after three-months at varying conditions.

TABLE 13

| Condition | 40° F. | 70° F./20% RH | 100° F./80% RH | 120° F. |
|---|---|---|---|---|
| Time | | | | |
| Initial | 66.86 | 66.86 | 66.86 | 66.86 |
| 1 month | 70.47 | 64.88 | 45.39 | 43.18 |
| 3 month | 70.33 | 64.87 | 30.62 | 42.06 |

EXAMPLE 35

In the following example, the powder detergent of example 34 was used, except the whitening agent particles comprised 73% sodium lauryl sulfate, 24% Optiblanc 2M/G LT, and 3% of Neodol 25-7. After 2 months at ambient temperature, the Whiteness Index was 70.85, and at 40° F. the Whiteness Index was 70.62, and at 120° F. the Whiteness Index was 56.90. Although the Whiteness Index after 2 months at 120° F. was less than at ambient temperature, it was still above the acceptable level of about 45.

EXAMPLE 36

In the following example, a powder detergent containing 62.02% sodium carbonate, 2.8% of cellulose gum, 4.4% of sodium silicate, 3% of sodium citrate, 11.05% of a blend of Pareth 25-7 and Pareth 45-7 (a $C_{14}$–$C_{15}$ alcohol ethoxylated with 7 moles of ethylene oxide), 1.7% of Pareth 25-3 (a $C_{12}$–$C_{13}$ alcohol ethoxylated with 3 moles of ethylene oxide), 2.1% of quaternary ammonium chloride, 11% of liquid sodium silicate, 4.88% of detergent ingredients (fragrances, enzymes, sodium hydroxide, dispersant, terpolymer, brightener), loss of 3% of water to drying, and 0.6% of Optiblanc 2M/G LT was tested after 3 weeks and after 6 weeks. The Optiblanc 2M/G LT was simply post-added to the powder detergent and was not formulated into a particle in accordance with the present invention. Table 14 shows the rapid degradation in the bulk color of the detergent when the whitening agent is not formulated as a particle in accordance with the present invention.

TABLE 14

| Condition | 70° F./20% RH | 120° F. |
|---|---|---|
| Time | | |
| Initial | 60.69 | 60.69 |
| 3 weeks | 52.19 | 38.98 |
| 6 weeks | 53.07 | 30.26 |

EXAMPLE 37

In the following example, a powder detergent was prepared containing 52.8% sodium carbonate, 3.3% precipitated silica, 2% cellulose gum, 22% Pareth 25-7 (a $C_{12}$–$C_{15}$ alcohol ethoxylated with an average of 7 moles of ethylene oxide), 7.5% citric acid for agglomeration, 4% of added water for agglomeration (of which 2.37% was removed by drying), 5% post-added acidulant (fumaric acid), 2.1% detergent adjuvants (enzyme and fragrance). To this detergent, 0.9% of Optiblanc 2M/G LT (not in the form of a particle according to the present invention) and 2.7% of sodium lauryl sulfate were separately added and the resulting detergent was stored over a period of three months under different conditions. Specifically, a portion of the detergent was stored at ambient temperature, a portion was stored at 100° F. and 80% relative humidity, and a portion was stored at 120° F. Each portion consisted of three samples (A, B, C).

Likewise, to the above detergent, 3.6% of whitener particles made according to the process of the present invention and comprising 24.5% whitening agent (Optiblanc 2M/G LT), 73.50.1% sodium lauryl sulfate, and 1.99% water was added and the resulting detergent was stored over a period of three months under different conditions. Specifically, a portion of the detergent was stored at ambient temperature, a portion was stored at 100° F. and 80% relative humidity, and a portion was stored at 120° F. Each portion consisted of three samples (D, E, F).

Table 15 shows the average of five measurements of the Whiteness Index measured in the same manner as described in Examples 34–36, for all of the samples at ambient temperature Table 16 shows the average of five measurements of the Whiteness Index measured in the same manner as described in Examples 34–36 for all of the samples at 100° F. and 80% relative humidity. And Table 17 shows the average of five measurements of the Whiteness Index measured in the same manner as described in Examples 34–36 for all of the samples at 120° F.

As seen by a comparison of the results, when the whitener is formulated into a particle according to the method of the present invention, the whitener does not degrade as quickly as the whitener that is not in the form of a particle according to the present invention. It is noted that values below 45 are considered to be unacceptable, i.e., exhibiting discoloration (degradation of the whitener) in the bulk detergent

TABLE 15

| | (Ambient Temperature) | | | | | |
|---|---|---|---|---|---|---|
| Time/Sample | A | B | C | D | E | F |
| Initial | 86.35 | 86.10 | 85.38 | 90.38 | 93.55 | 91.97 |
| 1 Month | 73.83 | 72.89 | 71.39 | 93.08 | 89.21 | 90.78 |
| 3 Month | 62.13 | 60.59 | 58.77 | 83.21 | 84.92 | 87.40 |

TABLE 16

| | (100° F. and 80% Relative Humidity) | | | | | |
|---|---|---|---|---|---|---|
| Time/Sample | A | B | C | D | E | F |
| Initial | 85.50 | 83.29 | 83.12 | 91.75 | 90.72 | 90.76 |
| 1 Month | 30.25 | 30.20 | 30.55 | 63.61 | 66.52 | 66.86 |
| 3 Month | 18.06 | 14.58 | 14.72 | 49.80 | 50.59 | 49.87 |

TABLE 17

| | (120° F.) | | | | | |
|---|---|---|---|---|---|---|
| Time/Sample | A | B | C | D | E | F |
| Initial | 82.98 | 84.17 | 84.95 | 89.66 | 90.41 | 89.72 |
| 1 Month | 46.62 | 49.13 | 48.70 | 76.09 | 75.73 | 75.01 |
| 3 Month | 42.23 | 42.99 | 45.36 | 72.35 | 71.50 | 67.22 |

While the foregoing has demonstrated the applicability of post-adding an acidulant and whitening agent particles for the above-described base detergents, it should be understood that the post-addition of the above-described acidulant and whitening agent particles may also be useful for other powder detergents, and the like. It should also be understood that a wide range of changes and modifications can be made to the embodiments described above. It is therefore intended that the foregoing description illustrates rather than limits this invention, and that it is the following claims, including all equivalents, which define this invention.

What is claimed is:

1. A powder laundry detergent composition comprising:

a. from about 55% to about 95% by weight of detergent base particles, wherein the detergent base particles comprise i. from about 5% to about 80% by weight of an inorganic carrier selected from the group consisting of phosphates and carbonates;

ii. from about 0.1% to about 90% by weight of a detergent surfactant selected from the group consisting of nonionic surfactants and wherein the nonionic surfactant is the sole detergent surfactant;

b. from about 0.1% to about 15% by weight of separate acidulant particles, wherein the acidulant particles are fumaric acid; and, c. from about 0.1% to about 30% by weight of separate solid homogeneous whitening agent particles comprising a whitener and a whitening agent surfactant.

2. The detergent composition of claim 1 wherein the inorganic carrier is an alkali metal carbonate.

3. The detergent composition of claim 1 wherein the nonionic surfactant has the formula $R^1(OC_2H_4)_nOH$, where $R^1$ is a $C_8$–$C_{18}$ alkyl group or a $C_8$–$C_{12}$ alkyl phenyl group, and n is from 3 to about 80.

4. The detergent composition of claim 1 wherein the ratio of inorganic carrier to acidulant particles is from about 2:1 to about 15:1.

5. The detergent composition of claim 1 wherein the ratio of detergent surfactant to whitening agent particles is from about 2:1 to about 40:1.

6. The detergent composition of claim 1 wherein the whitening agent particles further comprise water.

7. The detergent composition of claim 1 wherein the ratio of whitening agent surfactant to whitener is from about 1:1 to about 50:1 such that the particle reduces degradation of the whitener.

8. The detergent composition of claim 1 wherein the solid homogeneous whitening agent particles comprise:

a. from about 1% to about 50% by weight of a whitener;

b. from about 50% to about 95% by weight of a whitening agent surfactant selected from the group consisting of anionics, nonionics, zwitterionics, ampholytics, cationics, and mixtures thereof that are solids in a temperature range of from about 32° F. (0° C.) to about 180° F. (82° C.); and, c. from about 0.1% to about 10% by weight of water.

9. The detergent composition of claim 8 wherein the whitener is selected from the group consisting of diaminostilbenedisulfonic acids, diaminostilbenedisulfonic acid-cyanuric chlorides, and mixtures thereof.

10. The detergent composition of claim 9 wherein the whitening agent surfactant is an anionic surfactant.

11. The detergent composition of claim 10 wherein anionic surfactant is selected from the group consisting of alkali metal, ammonium and alkylolammonium salts of organic sulfuric reaction products having in their molecular structure an alkyl group containing from about 8 to about 20 carbon atoms and a sulfonic acid or sulfuric acid ester group.

12. The detergent composition of claim 8 wherein the ratio of whitening agent surfactant to water is from about 5:1 to about 70:1.

13. A phosphate-free powder laundry detergent composition comprising:

a. from about 55% to about 95% by weight of agglomerated detergent particles comprising from about 5% to about 80% by weight of an alkali metal carbonate and from about 1% to about 90% by weight of a nonionic detergent surfactant, wherein the nonionic detergent surfactant is the sole detergent surfactant present;

b. from about 0.1% to about 15% by weight of separate acidulant particles, wherein the acidulant particles are fumaric acid; and, c. from about 0.1% to about 30% by weight of separate solid homogeneous whitening agent particles with the particles comprising from about 1% to about 50% by weight of a whitener; from about 50% to about 95% by weight of a whitening agent surfactant selected from the group consisting of anionics, nonionics, zwitterionics, ampholytics, cationics, and mixtures thereof that are solids in a temperature range of from about 32° F. (0° C.) to about 180° F. (82° C.); and, from about 0.1% to about 10% by weight of water.

14. A method of making a detergent composition comprising the steps of:

a. providing powder laundry detergent base particles, wherein the particles comprise from about 5% to about 80% by weight of an inorganic carrier selected from the group consisting of phosphates and carbonates and from about 1% to about 90% by weight of a detergent surfactant selected from the group consisting of nonionic surfactants and wherein the nonionic surfactant is the sole detergent surfactant;

b. admixing from about 0.1% to about 15% by weight of the detergent composition, acidulant particles to the detergent base, wherein the acidulant particles are fumaric acid; and, c. admixing from about 0.1% to about 30% by weight of the detergent composition solid whitening agent particles to the detergent base, wherein the solid whitening agent particles comprise a whitener and a whitening agent surfactant.

15. The method of claim 14 wherein the inorganic carrier is an alkali metal carbonate.

16. The method of claim 14 wherein the nonionic surfactant has the formula $R^1(OC_2H_4)_nOH$, where $R^1$ is a $C_8$–$C_{18}$ alkyl group or a $C_8$–$C_{12}$ alkyl phenyl group, and n is from 3 to about 80.

17. The method of claim 14 wherein the ratio of inorganic carrier to acidulant particles is from about 2:1 to about 15:1.

18. The method of claim 14 wherein the ratio of detergent surfactant to whitening agent particles is from about 2:1 to about 40:1.

19. The method of claim 18 wherein the whitening agent particles further comprise water.

20. The method of claim 18 wherein the ratio of whitening agent surfactant to whitener is from about 1:1 to about 50:1 such that the particle reduces degradation of the whitener.

21. The method of claim 14 wherein the solid whitening agent particles comprise:

a. from about 0.1% to about 50% by weight of a whitener;

b. from about 50% to about 95% by weight of a whitening agent surfactant selected from the group consisting of anionics, nonionics, zwitterionics, ampholytics, cationics, and mixtures thereof that are solids in a temperature range of from about 32° F. (0° C.) to about 180° F. (82° C.); and, c. from about 0.1% to about 10% by weight of water.

22. The method of claim 21 wherein the whitener is selected from the group consisting of diaminostilbenedisulfonic acids, diaminostilbenedisulfonic acid-cyanuric chlorides, and mixtures thereof.

23. The method of claim 22 wherein the whitening agent surfactant is an anionic surfactant.

24. The method of claim 23 wherein the anionic surfactant is selected from the group consisting of alkali metal, ammonium and alkylolammonium salts of organic sulfuric reaction products having in their molecular structure an alkyl group containing from about 8 to about 20 carbon atoms and a sulfonic acid or sulfuric acid ester group.

25. The method of claim 21 wherein the ratio of whitening agent surfactant to water is from about 5:1 to about 70:1.

26. A method for making a phosphate-free detergent composition comprising the steps of:

a. agglomerating a mixture comprising from about 5% to about 80% by weight of an alkali metal carbonate and from about 1% to about 90% by weight of a nonionic detergent surfactant wherein the nonionic detergent surfactant is the sole detergent surfactant present;

b. drying the mixture to form powdered particles;

c. adding to the powdered particles from about 0.1% to about 15% by weight of the detergent composition solid acidulant particles, wherein the acidulant particles are fumaric acid; and, d. adding to the powdered particles from about 0.1% to about 30% by weight of the detergent composition separate solid whitening agent particles wherein the solid whitening agent particles comprise a whitener and a whitening agent surfactant.

* * * * *

UNITED STATES PATENT AND TRADEMARK OFFICE

CERTIFICATE OF CORRECTION

PATENT NO. : 6,080,711

DATED : June 27, 2000

INVENTOR(S) : Steven J. Brouwer et al.

It is certified that error appears in the above-identified patent and that said Letters Patent is hereby corrected as shown below:

On the Title Page

In column 1, item [75], delete "Hudsonville" and substitute --Rockford-- in its place.

In the Claims

In claim 1, lines 8, 12 and 15, delete "0.1%" and substitute --1%-- in its place.

In claim 21, lines 3 and 10, delete "0.1%" and substitute --1%-- in its place.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*